US007473350B2

(12) United States Patent
Brown et al.

(10) Patent No.: US 7,473,350 B2
(45) Date of Patent: Jan. 6, 2009

(54) CONTROL METHODOLOGY FOR DESULFURIZATION PROCESS

(75) Inventors: Ronald Eugene Brown, Bartlesville, OK (US); Warren Matthew Ewert, Bartlesville, OK (US)

(73) Assignee: China Petroleum & Chemical Corporation, Beijing (CN)

( * ) Notice: Subject to any disclaimer, the term of this patent is extended or adjusted under 35 U.S.C. 154(b) by 486 days.

(21) Appl. No.: 11/034,796

(22) Filed: Jan. 13, 2005

(65) Prior Publication Data

US 2006/0151358 A1 Jul. 13, 2006

(51) Int. Cl.
*C10G 29/00* (2006.01)
*C10G 45/00* (2006.01)
*C07C 7/12* (2006.01)

(52) U.S. Cl. ..... 208/209; 208/210; 208/243; 208/244; 208/245; 208/246; 208/247; 208/248; 208/249; 208/250; 585/820

(58) Field of Classification Search ..... 208/209, 208/210, 243–250; 585/820
See application file for complete search history.

(56) References Cited

U.S. PATENT DOCUMENTS 5,358,921 A * 10/1994 Kidd et al. ..... 502/407
5,853,570 A 12/1998 Hatanaka et al.
5,985,136 A 11/1999 Brignac et al.
6,184,176 B1 2/2001 Khare
6,228,254 B1 5/2001 Jossens et al.
6,231,754 B1 5/2001 Brignac et al.
6,254,766 B1 * 7/2001 Sughrue et al. ..... 208/244
6,271,173 B1 8/2001 Khare
6,338,794 B1 1/2002 Khare
6,346,190 B1 2/2002 Khare
6,350,422 B1 2/2002 Khare et al.
6,409,913 B1 6/2002 Clark et al.
6,428,685 B2 8/2002 Khare
6,429,170 B1 8/2002 Dodwell
6,479,429 B1 11/2002 Khare
6,482,314 B1 11/2002 Khare
6,531,053 B2 3/2003 Khare
6,544,410 B1 4/2003 Gislason et al.
6,676,829 B1 1/2004 Angevine et al.
2002/0043484 A1 4/2002 Khare
2003/0029777 A1 2/2003 Khare
2003/0032555 A1 2/2003 Dodwell
2004/0262200 A1 * 12/2004 Sughure et al. ..... 208/208 R

* cited by examiner

*Primary Examiner*—Walter D Griffin
*Assistant Examiner*—Lessanework Seifu
(74) *Attorney, Agent, or Firm*—Hovey Williams LLP

(57) ABSTRACT

A desulfurization system is operated in a manner which optimizes sulfur removal and octane retention. When the desulfurization reactor is operated at a specific ratio of total pressure to hydrogen partial pressure ($P_T/P_H$) and/or within a specific temperature range, optimum sulfur removal and octane retention are realized. The desulfurization reactor can be maintained at these optimized operating conditions by automatically adjusting one or more operating parameters of the desulfurization reactor in order to maintain a substantially constant hydrogen partial pressure ($P_H$) in the reactor. Maintaining a relatively constant hydrogen partial pressure ($P_H$) in the desulfurization reactor helps ensure a relatively consistent degree of desulfurization.

47 Claims, 4 Drawing Sheets

CONTROL METHODOLOGY FOR DESULFURIZATION PROCESS

BACKGROUND OF THE INVENTION

This invention relates generally to systems for desulfurizing hydrocarbon-containing fluid streams such as cracked-gasoline. In another aspect, the invention concerns a method for operating a hydrocarbon desulfurization process to maximize sulfur removal while minimizing octane loss.

Hydrocarbon-containing fluids, such as gasoline, typically contain sulfur. High levels of sulfur in gasoline are undesirable because oxides of sulfur present in automotive exhaust may irreversibly poison noble metal catalysts employed in automobile catalytic converters. Emissions from such poisoned catalytic converters may contain high levels of non-combusted hydrocarbons, oxides of nitrogen, and/or carbon monoxide, which, when catalyzed by sunlight, form ground level ozone, more commonly referred to as smog.

Much of the sulfur present in the final blend of most gasolines originates from a gasoline blending component commonly known as "cracked-gasoline." Thus, reduction of sulfur levels in cracked-gasoline will inherently serve to reduce sulfur levels in most gasolines, such as, automobile gasolines, racing gasolines, aviation gasolines, boat gasolines, and the like. Many conventional processes exist for removing sulfur from cracked-gasoline. However, most conventional sulfur removal processes, such as hydrodesulfurization, tend to saturate olefins and aromatics in the cracked-gasoline and thereby reduce its octane number (both research and motor octane number). Thus, there is a need for a process wherein desulfurization of cracked-gasoline is maximized with minimal or no octane loss.

SUMMARY OF THE INVENTION

Accordingly, it is an object of the present invention to provide a novel desulfurization process wherein sulfur removal is enhanced and octane loss is minimized.

A further object of the present invention is to provide a novel method for operating a desulfurization unit wherein one or more operating parameters of the desulfurization unit are adjusted during sulfur removal so that maximum desulfurization and minimum octane loss are maintained.

It should be noted that the above-listed objects need not all be accomplished by the invention claimed herein and other objects and advantages of the invention will be apparent from the detailed description of the preferred embodiments and the appended claims.

One aspect of the present invention concerns a desulfurization process comprising: (a) contacting a feed stream with a sorbent in a desulfurization zone under desulfurization conditions sufficient to transfer sulfur from the feed stream to the sorbent, wherein the feed stream comprises hydrogen ($H_2$) and hydrocarbons (HC) in a $H_2$/HC molar ratio less than 0.7, wherein the desulfurization conditions include a total pressure ($P_T$) and a hydrogen partial pressure ($P_H$) at a $P_T/P_H$ ratio of at least 2.5; (b) contacting at least a portion of the sorbent with an oxygen-containing regeneration stream in a regeneration zone; and (c) contacting at least a portion of the sorbent with a hydrogen-containing reducing stream in a reducing zone.

Another aspect of the present invention concerns a process for removing sulfur from a hydrocarbon-containing feed stream to thereby produce a desulfurized hydrocarbon-containing product stream. The process comprises: (a) determining an average sulfur content ($S_F$) of the hydrocarbon components of the feed stream; (b) determining a desired sulfur content ($S_P$) of the hydrocarbon components of the product stream; and (c) contacting the feed stream with a sorbent in a desulfurization zone under desulfurization conditions sufficient to remove sulfur from the feed stream, wherein the feed stream comprises hydrogen ($H_2$) and hydrocarbons (HC) in a $H_2$/HC molar ratio less than 0.7, wherein the desulfurization conditions include a total pressure ($P_T$) and a hydrogen partial pressure ($P_H$) at a $P_T/P_H$ ratio greater than 2.5, wherein the $P_H$ is within about 50 percent of a calculated hydrogen partial pressure ($P_{Hcalc}$) determined according to the following equation:

$$P_{Hcalc} = 0.256 \times [206 + 0.11(S_F - 125)]^{\left(\frac{25}{S_P}\right)^{0.04}}$$

wherein $S_F$ and $S_P$ are expressed in parts per million by weight (ppmw) and $P_{Hcalc}$ is expressed in pounds per square inch absolute (psia).

A further aspect of the present invention concerns a desulfurization process comprising: (a) combining a hydrogen stream and a hydrocarbon stream in a substantially continuous manner to thereby form a feed stream having a hydrogen-to-hydrocarbon molar ratio ($H_2$/HC), wherein the hydrogen stream has a hydrogen purity representing the mole percent of pure hydrogen ($H_2$) in the hydrogen stream; (b) contacting the feed stream with a sorbent in a desulfurization zone under desulfurization conditions sufficient to transfer sulfur from the feed stream to the sorbent, wherein the desulfurization conditions include a total pressure ($P_T$) and a hydrogen partial pressure ($P_H$); and (c) simultaneously with step (b), adjusting an operating parameter selected from the group consisting of the $P_T$, the $H_2$/HC molar ratio, the hydrogen purity, and combinations thereof to thereby maintain the $P_H$ at a substantially constant value.

Yet another aspect of the present invention concerns a desulfurization process comprising: (a) contacting a hydrocarbon-containing feed stream with a zinc oxide-containing sorbent composition under desulfurization conditions sufficient to remove sulfur from the feed stream and thereby provide a sulfur-loaded sorbent composition and a sulfur-reduced hydrocarbon-containing product stream, wherein the desulfurization conditions include a desulfurization temperature in the range of from about 770° F. to about 830° F.; (b) contacting the sulfur-loaded sorbent composition with an oxygen-containing regeneration stream under regeneration conditions sufficient to remove sulfur from the sulfur-loaded sorbent composition and thereby provide an oxidized sorbent composition; and (c) contacting the oxidized sorbent composition with a hydrogen-containing reducing stream under reducing conditions sufficient to reduce the oxidized sorbent composition and thereby provide an activated sorbent composition.

DETAILED DESCRIPTION OF THE PREFERRED EMBODIMENTS

Figure 1:
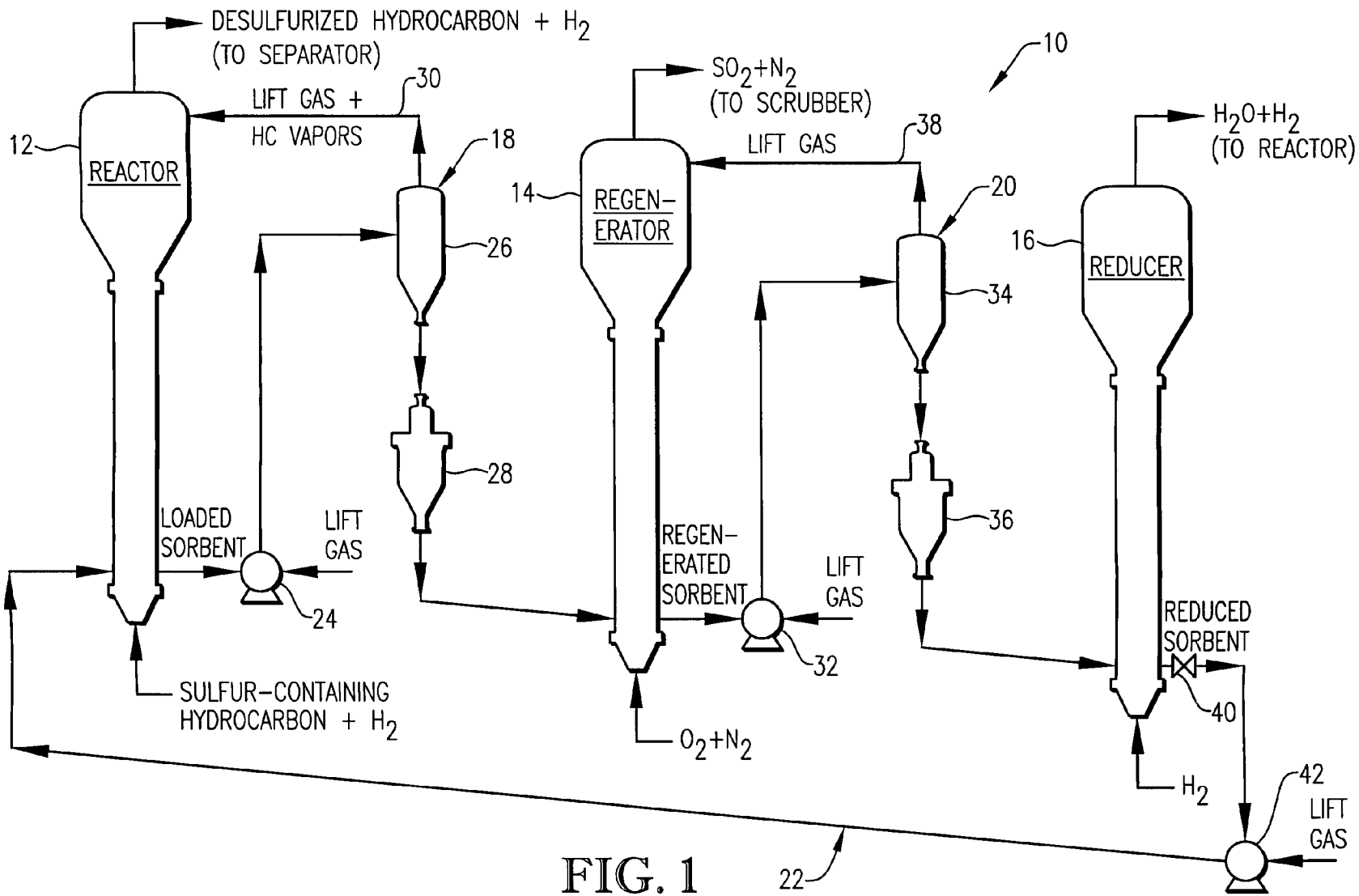
FIG. 1 is a schematic process flow diagram of a desulfurization unit constructed in accordance with the principals of the present invention, particularly illustrating the manner in which a sorbent-containing solid particulate system is continuously circulated through the reactor, regenerator, and reducer vessels of the unit.

Referring initially to FIG. 1, a desulfurization unit 10 is illustrated as generally comprising a fluidized bed reactor 12, a fluidized bed regenerator 14, and a fluidized bed reducer 16. A system of finely divided solid particles is circulated in desulfurization unit 10 to provide for substantially continuous sulfur removal (in reactor 12) from a sulfur-containing hydrocarbon, such as cracked-gasoline. The finely divided solid particulate system employed in desulfurization unit 10 can consist of a plurality of solid sorbent particles which are operable to facilitate the removal of sulfur from a fluid stream via transfer of the sulfur from the fluid stream to the sorbent particles.

In an alternative embodiment, the finely divided solid particulate system employed in desulfurization unit 10 can comprise an unbound mixture of individual sorbent particles and individual catalyst particles, wherein the sorbent particles function as a sulfur getter and the catalyst particles function as an octane enhancer. When the solid particulate system employs both sorbent and catalyst particles, it is preferred for the weight ratio of the sorbent particles to the catalyst particles to be in the range of from about 100:1 to about 4:1, more preferably from about 40:1 to about 5:1, and most preferably from 20:1 to 10:1.

The optional solid catalyst particles can be any sufficiently fluidizable, circulatable, and regenerable solid acid catalyst having sufficient isomerization activity, cracking activity, attrition resistance, and coke resistance at the operating conditions of desulfurization unit 10. The catalyst particles preferably comprise a zeolite in an amount in the range of from about 5 to about 50 weight percent, with the balance being a conventional binder system such as clay (e.g., kaolin clay) or a mixture of clay and a binding alumina. Most preferably, the catalyst particles comprise the zeolite in an amount in the range of from 10 to 30 weight percent. It is preferred for the largest ring of the zeolite employed in the optional catalyst particles of the present invention to have at least 8 T-atoms. More preferably, the largest ring of the zeolite has at least 10 T-atoms, still more preferably the largest ring of the zeolite has 10 to 12 T-atoms, and most preferably the largest ring of the zeolite has 10 T-atoms. It is further preferred for the zeolite to have a channel dimensionality of 3. It is preferred for the zeolite employed in the optional catalyst particles of the present invention to have a framework type code selected from the group consisting of AEL, AET, AFI, AFO, AFR, AFS, AFY, AHT, ASV, ATO, ATS, BEA, BEC, BOG, BPH, CAN, CFI, CGF, CGS, CLO, CON, CZP, DAC, DFO, DON, EMT, EPI, EUO, FAU, FER, GME, GON, HEU, IFR, ISV, LAU, LTL, MAZ, MEI, MEL, MFI, MFS, MOR, MTT, MTW, MWW, NES, OFF, OSI, OSO, PAR, RON, SAO, SBE, SBS, SBT, SFE, SFF, SFG, STF, STI, TER, TON, VET, VFI, WEI, and WEN. More preferably, the zeolite has a framework type code selected from the group consisting of AFS, AFY, BEA, BEC, BHP, CGS, CLO, CON, DFO, EMT, FAU, GME, ISV, MEI, MEL, MFI, SAO, SBS, SBT, and WEN. Still more preferably the zeolite has an MFI framework type code. The above-listed framework type codes follow the rules of the IUPAC Commission on Zeolite Nomenclature in 1978, as outlined in R. M. Barrer, "Chemical Nomenclature and Formulation of Compositions of Synthetic and Natural Zeolites", *Pure Appl. Chem.* 51, 1091 (1979). Further information on framework type codes is available in Ch. Baerlocher, W. M. Meier, D. H. Olson, *Atlas of Zeolite Framework Types,* 5th ed., Elsevier, Amsterdam (2001), the entire disclosure of which is hereby incorporated by reference. Most preferably, the zeolite of the catalyst particles is ZSM-5 that has been ion exchanged and calcined so that it exists in its hydrogen form (i.e., H-ZSM-5).

The sorbent particles of the solid particulate system, which can be employed in desulfurization unit 10 alone or in combination with the catalyst particles described above, can be any sufficiently fluidizable, circulatable, and regenerable zinc oxide-based composition having sufficient desulfurization activity and sufficient attrition resistance at the operating conditions of desulfurization unit 10. A description of such a sorbent composition is provided in U.S. Pat. Nos. 6,429,170 and 6,656,877, the entire disclosures of which are incorporated herein by reference.

In fluidized bed reactor 12, a hydrocarbon-containing fluid stream is passed upwardly through a fluidized bed of the solid particulate system so that the reduced solid sorbent and optional catalyst particles present in reactor 12 are contacted with the fluid stream. The reduced solid sorbent particles contacted with the hydrocarbon-containing stream in reactor 12 preferably initially (i.e., immediately prior to contacting with the hydrocarbon-containing fluid stream) comprise zinc oxide and a reduced-valence promoter metal component. Though not wishing to be bound by theory, it is believed that the reduced-valence promoter metal component of the reduced solid sorbent particles facilitates the removal of sulfur from the hydrocarbon-containing stream, while the zinc oxide component operates as a sulfur storage mechanism via conversion to zinc sulfide.

The reduced-valence promoter metal component of the reduced solid sorbent particles preferably comprises a promoter metal selected from a group consisting of nickel, cobalt, iron, manganese, tungsten, silver, gold, copper, platinum, zinc, tin, ruthenium, molybdenum, antimony, vanadium, iridium, chromium, and palladium. More preferably, the reduced-valence promoter metal component comprises nickel as the promoter metal. As used herein, the term "reduced-valence" when describing the promoter metal component, shall denote a promoter metal component having a valence which is less than the valence of the promoter metal component in its common oxidized state. More specifically, the reduced solid sorbent particles employed in reactor 12 should include a promoter metal component having a valence which is less than the valence of the promoter metal component of the regenerated (i.e., oxidized) solid sorbent particulates exiting regenerator 14. Most preferably, substantially all of the promoter metal component of the reduced solid sorbent particulates has a valence of zero.

In a preferred embodiment of the present invention, the reduced-valence promoter metal component comprises, consists of, or consists essentially of, a substitutional solid metal solution characterized by the formula: $M_AZn_B$, wherein M is the promoter metal and A and B are each numerical values in the range of from 0.01 to 0.99. In the above formula for the substitutional solid metal solution, it is preferred for A to be in the range of from about 0.70 to about 0.97, and most preferably in the range of from about 0.85 to about 0.95. It is further preferred for B to be in the range of from about 0.03 to about 0.30, and most preferably in the range of from about 0.05 to 0.15. Preferably, B is equal to (1−A).

Substitutional solid solutions have unique physical and chemical properties that are important to the chemistry of the sorbent composition described herein. Substitutional solid solutions are a subset of alloys that are formed by the direct substitution of the solute metal for the solvent metal atoms in the crystal structure. For example, it is believed that the substitutional solid metal solution ($M_AZn_B$) found in the reduced solid sorbent particles is formed by the solute zinc metal atoms substituting for the solvent promoter metal atoms. There are three basic criteria that favor the formation of substitutional solid solutions: (1) the atomic radii of the two elements are within 15 percent of each other; (2) the crystal structures of the two pure phases are the same; and (3) the electronegativities of the two components are similar. The promoter metal (as the elemental metal or metal oxide) and zinc oxide employed in the solid sorbent particles described herein preferably meet at least two of the three criteria set forth above. For example, when the promoter metal is nickel, the first and third criteria are met, but the second is not. The nickel and zinc metal atomic radii are within 10 percent of each other and the electronegativities are similar. However, nickel oxide (NiO) preferentially forms a cubic crystal structure, while zinc oxide (ZnO) prefers a hexagonal crystal structure. A nickel zinc solid solution retains the cubic structure of the nickel oxide. Forcing the zinc oxide to reside in the cubic structure increases the energy of the phase, which limits the amount of zinc that can be dissolved in the nickel oxide structure. This stoichiometric control manifests itself microscopically in a 92:8 nickel zinc solid solution ($Ni_{0.92}Zn_{0.08}$) that is formed during reduction and microscopically in the repeated regenerability of the solid sorbent particles.

In addition to zinc oxide and the reduced-valence promoter metal component, the reduced solid sorbent particles employed in reactor 12 may further comprise a porosity enhancer and an aluminate. The aluminate is preferably a promoter metal-zinc aluminate substitutional solid solution. The promoter metal-zinc aluminate substitutional solid solution can be characterized by the formula: $M_ZZn_{(1-Z)}Al_2O_4$, wherein Z is a numerical value in the range of from 0.01 to 0.99. The porosity enhancer, when employed, can be any compound which ultimately increases the macroporosity of the solid sorbent particles. Preferably, the porosity enhancer is perlite. The term "perlite" as used herein is the petrographic term for a siliceous volcanic rock which naturally occurs in certain regions throughout the world. The distinguishing feature, which sets it apart from other volcanic minerals, is its ability to expand four to twenty times its original volume when heated to certain temperatures. When heated above 1,600° F., crushed perlite expands due to the presence of combined water within the crude perlite rock. The combined water vaporizes during the heating process and creates countless tiny bubbles in the heat-softened glassy particles. It is these diminutive glass-sealed bubbles which account for its light weight. Expanded perlite can be manufactured to weigh as little as 2.5 lbs per cubic foot. Typical chemical analysis properties of expanded perlite are: silicon dioxide 73%, aluminum oxide 17%, potassium oxide 5%, sodium oxide 3%, calcium oxide 1%, plus trace elements. Typical physical properties of expanded perlite are: softening point 1,600-2,000° F., fusion point 2,300-2,450° F., pH 6.6-6.8, and specific gravity 2.2-2.4. The term "expanded perlite" as used herein refers to the spherical form of perlite which has been expanded by heating the perlite siliceous volcanic rock to a temperature above 1,600° F. The term "particulate expanded perlite" or "milled perlite" as used herein denotes that form of expanded perlite which has been subjected to crushing so as to form a particulate mass wherein the particle size of such mass is comprised of at least 97 percent of particles having a size of less than two microns. The term "milled expanded perlite" is intended to mean the product resulting from subjecting expanded perlite particles to milling or crushing.

The reduced solid sorbent particles initially contacted with the hydrocarbon-containing fluid stream in reactor 12 can comprise zinc oxide, the reduced-valence promoter metal component ($M_AZn_B$), the porosity enhancer (PE), and the promoter metal-zinc aluminate ($M_ZZn_{(1-Z)}Al_2O_4$) in the ranges provided below in Table 1.

TABLE 1

Components of the Reduced Solid Sorbent Particulates

| Range | ZnO (wt %) | $M_AZn_B$ (wt %) | PE (wt %) | $M_ZZn_{(1-Z)}Al_2O_4$ (wt %) |
|---|---|---|---|---|
| Preferred | 5-80 | 5-80 | 2-50 | 1-50 |
| More Preferred | 20-60 | 20-60 | 5-30 | 5-30 |
| Most Preferred | 30-50 | 30-40 | 10-20 | 10-20 |

The physical properties of the sorbent and optional catalyst particles of the solid particulate system can significantly affect the particulate system's suitability for use in desulfurization unit 10. Key physical properties of the solid particles (i.e., the sorbent particles alone or in combination with the catalyst particles) include, for example, particle shape, particle size, particle density, and resistance to attrition. The particles of the solid particulate system employed in desulfurization unit 10 preferably comprise substantially microspherical particles having a mean particle size in the range of from about 20 to about 200 microns, more preferably in the range of from about 40 to about 150 microns, and most preferably in the range of from about 50 to about 100 microns. As used herein, the term "finely divided" denotes particles having a mean particle size less than 500 microns.

The average density of the sorbent particles is preferably in the range of from about 0.5 to about 1.5 grams per cubic centimeter (g/cc), more preferably in the range of from about 0.8 to about 1.3 g/cc, and most preferably in the range of from 0.9 to 1.2 g/cc. When catalyst particles are employed as a component of the solid particulate system, the average density of the catalyst particles is preferably within about 50 percent of the average density of the sorbent particulates, more preferably within about 25 percent of the average density of the sorbent particulates. The particle size and density of the individual particles of the solid particulate system preferably qualify the particles as Group A solids under the Geldart group classification system described in *Powder Technol.*, 7, 285-292 (1973). The individual particles of the solid particulate system preferably have high resistance to attrition. As used herein, the term "attrition resistance" denotes a measure of a particle's resistance to size reduction under controlled conditions of turbulent motion. The attrition resistance of a particle can be quantified using the jet cup attrition test, similar to the Davidson Index. The Jet Cup Attrition Index represents the weight percent of the over 44 micrometer particle-size fraction which is reduced to particle sizes of less than 37 micrometers under test conditions and involves screening a 5 gram sample of solid particles to remove particles in the 0 to 44 micrometer size range. The particles above 44 micrometers are then subjected to a tangential jet of air at a rate of 21 liters per minute introduced through a 0.0625 inch orifice fixed at the bottom of a specially designed jet cup (1" I.D.×2" height) for a period of 1 hour. The Jet Cup Attrition Index (JCAI) is calculated as follows:

$$JCAI = \frac{Wt.\text{ of 0-37 Micrometer Formed During Test}}{Wt.\text{ of Original} + 44\text{ Micrometer Fraction Being Tested}} \times 100 \times CF$$

The Correction Factor (CF) (presently 0.30) is determined by using a known calibration standard to adjust for differences in jet cup dimensions and wear. The individual particles of the solid particulate system employed in the present invention preferably have a Jet Cup Attrition Index value of less than about 30, more preferably less than about 20, and most preferably less than 15.

The hydrocarbon-containing feed stream contacted with the solid particulate system in reactor 12 preferably comprises a sulfur-containing hydrocarbon and hydrogen. Preferably, the sulfur-containing hydrocarbon is a fluid that is normally in a liquid state at standard temperature and pressure (STP), but is combined with hydrogen and vaporized prior to or during introduction into reactor 12. The sulfur-containing hydrocarbon preferably can be used as a fuel or a precursor to fuel. Examples of suitable sulfur-containing hydrocarbons include cracked-gasoline, diesel fuels, jet fuels, straight-run naphtha, straight-run distillates, coker gas oil, coker naphtha, alkylates, and straight-run gas oil. More preferably, the sulfur-containing hydrocarbon comprises a hydrocarbon fluid selected from the group consisting of gasoline, cracked-gasoline, and mixtures thereof. Most preferably, the sulfur-containing hydrocarbon is cracked-gasoline.

As used herein, the term "gasoline" denotes a mixture of hydrocarbons boiling in a range of from about 100° F. to about 400° F., or any fraction thereof. Examples of suitable gasolines include, but are not limited to, hydrocarbon streams in refineries such as naphtha, straight-run naphtha, coker naphtha, catalytic gasoline, visbreaker naphtha, alkylates, isomerate, reformate, and the like, and mixtures thereof.

As used herein, the term "cracked-gasoline" denotes a mixture of hydrocarbons boiling in a range of from about 100° F. to about 400° F., or any fraction thereof, that are products of either thermal or catalytic processes that crack larger hydrocarbon molecules into smaller molecules. Examples of suitable thermal processes include, but are not limited to, coking, thermal cracking, visbreaking, and the like, and combinations thereof. Examples of suitable catalytic cracking processes include, but are not limited to, fluid catalytic cracking, heavy oil cracking, and the like, and combinations thereof. Thus, examples of suitable cracked-gasolines include, but are not limited to, coker gasoline, thermally cracked gasoline, visbreaker gasoline, fluid catalytically cracked (FCC) gasoline, heavy oil cracked-gasoline and the like, and combinations thereof. In some instances, the cracked-gasoline may be fractionated and/or hydrotreated prior to desulfurization when used as the sulfur-containing fluid in the process in the present invention.

The sulfur-containing hydrocarbon fluid described herein as a suitable feed component of the inventive desulfurization process typically comprises a quantity of olefins, aromatics, and sulfur, as well as paraffins and naphthenes. The amount of olefins in cracked-gasoline is generally in a range of from about 10 to about 35 weight percent olefins based on the total weight of the gaseous cracked-gasoline. The amount of aromatics in cracked-gasoline is generally in a range of from about 20 to about 40 weight percent aromatics based on the total weight of the gaseous cracked-gasoline. The amount of atomic sulfur in the sulfur-containing hydrocarbon fluid, preferably cracked-gasoline, suitable for use in the inventive desulfurization process is generally greater than about 50 parts per million by weight (ppmw) of the sulfur-containing hydrocarbons, more preferably in a range of from about 100 ppmw atomic sulfur to about 10,000 ppmw atomic sulfur, and most preferably from 150 ppmw atomic sulfur to 500 ppmw atomic sulfur. It is preferred for at least about 50 weight percent of the atomic sulfur present in the sulfur-containing hydrocarbon fluid employed in the present invention to be in the form of organosulfur compounds. More preferably, at least about 75 weight percent of the atomic sulfur present in the sulfur-containing hydrocarbon fluid is in the form of organosulfur compounds, and most preferably at least 90 weight percent of the atomic sulfur is in the form of organosulfur compounds. As used herein, "sulfur" used in conjunction with "ppmw sulfur" or the term "atomic sulfur," denotes the amount of atomic sulfur (about 32 atomic mass units) in the sulfur-containing hydrocarbon fluid, not the atomic mass, or weight, of a sulfur compound, such as an organosulfur compound.

The reactor can also contain oxygen in the range of from 1 to about 50 mole percent based upon the total amount of feed present in the reactor. More preferably, the reactor contains a range of from about 2 to about 30 mole percent and most preferably from 3 to 21 mole percent.

As used herein, the term "sulfur" denotes sulfur in any form normally present in a sulfur-containing hydrocarbon fluid such as cracked-gasoline or diesel fuel. Examples of such sulfur which can be removed from a sulfur-containing hydrocarbon fluid through the practice of the present invention include, but are not limited to, hydrogen sulfide, carbonyl sulfide (COS), carbon disulfide ($CS_2$), mercaptans (RSH), organic sulfides (R—S—R), organic disulfides (R—S—S—R), thiophene, substitute thiophenes, organic trisulfides, organic tetrasulfides, benzothiophene, alkyl thiophenes, alkyl benzothiophenes, alkyl dibenzothiophenes, and the like, and combinations thereof, as well as heavier molecular weights of the same which are normally present in sulfur-containing hydrocarbons of the types contemplated for use in the desulfurization process of the present invention, wherein each R can be an alkyl, cycloalkyl, or aryl group containing 1 to 10 carbon atoms.

As used herein, the term "fluid" denotes gas, liquid, vapor, and combinations thereof.

As used herein, the term "gaseous" denotes the state in which the sulfur-containing hydrocarbon fluid is primarily in a gas or vapor phase.

Referring again to FIG. 1, in fluidized bed reactor 12, the solid particulate system is contacted with the upwardly flowing gaseous hydrocarbon-containing feed stream (which comprises hydrogen and sulfur-containing hydrocarbons) under a set of desulfurization conditions sufficient to fluidize the bed of solid particles located in reactor 12. When the sorbent particles are contacted with the upwardly flowing feed stream under desulfurization conditions sulfur compounds, particularly organosulfur compounds, present in the hydrocarbon components of the feed stream are transferred to the sorbent particles and at least a portion of the sulfur removed from the hydrocarbons converts at least a portion of the zinc oxide of the reduced solid sorbent particles into zinc sulfide.

In contrast to many conventional sulfur removal processes (e.g., hydrodesulfurization), it is preferred that substantially none of the sulfur in the feed stream is converted to, and remains as, hydrogen sulfide ($H_2S$) during desulfurization in reactor 12. Rather, it is preferred that the desulfurized product from reactor 12 (generally comprising the desulfurized hydrocarbons and hydrogen) has the same or a lower concentration of $H_2S$ than the sulfur-containing feed stream charged to reactor 12 (generally comprising the sulfur-containing hydrocarbons and hydrogen). The desulfurized hydrocarbons of the product stream exiting reactor 12 preferably contain less than about 50 weight percent of the amount of sulfur in the sulfur-containing hydrocarbons of the feed stream charged to reactor 12, more preferably less than about 20 weight percent of the amount of sulfur in the sulfur-containing hydrocarbons of the feed stream, and most preferably less than 5 weight percent of the amount of sulfur in the sulfur-containing hydrocarbons of the feed stream. It is preferred for the total sulfur content of the desulfurized hydrocarbons of the product stream exiting reactor 12 to be less than about 50 parts per million by weight (ppmw), more preferably less than about 30 ppmw, still more preferably less than about 15 ppmw, and most preferably less than 10 ppmw.

When the solid particulate system employed in reactor 12 includes octane-enhancing catalyst particles, these catalyst particles may facilitate one or more of the following reactions at typical desulfurization conditions: mild cracking of C7+ olefins, dealkylation of naphthenes, and isomerization of olefins from the alpha position to the beta positions. The reactions catalyzed by the catalyst particles in reactor 12 provide an increase in the road octane of the resulting desulfurized product versus desulfurization with a solid particulate system employing no catalyst particles. As used herein, the terms "octane" and "road octane" shall denote the octane of a fuel calculated by summing the research octane number (RON) and the motor octane number (MON) and dividing the sum of the MON and RON by 2.

It has been discovered that desulfurization of the hydrocarbon-containing feed stream in reactor 12 can be optimized by carefully selecting and controlling certain operating parameters of reactor 12. Important operating parameters of reactor 12 include, for example, temperature, total pressure ($P_T$), hydrogen partial pressure ($P_H$), $P_T/P_H$ ratio, hydrogen-to-hydrocarbon molar ratio ($H_2$/HC), weight hourly space velocity (WHSV), and superficial velocity. The preferred ranges for such operating parameters are provided below in Table 2.

TABLE 2

Desulfurization Conditions

| | Preferred Range | More Preferred | Most Preferred |
|---|---|---|---|
| Temperature (° F.) | 750-850 | 770-830 | 775-825 |
| Total Pressure ($P_T$) (psig) | 125-650 | 200-550 | 225-450 |
| Hydrogen Partial Press. ($P_H$) (psia) | 50-200 | 60-150 | 70-120 |
| $P_T/P_H$ ratio | 2.5-8 | 3-6 | 3-4.5 |
| $H_2$/HC ratio | 0.2-0.7 | 0.2-0.5 | 3.25-5 |
| WHSV ($hr^{-1}$) | 1-15 | 2-10 | 3-8 |
| Superficial Velocity (ft/sec) | 0.25-5 | 0.5-2.5 | 1-2 |

One aspect of the present invention concerns the discovery that sulfur removal can be improved without sacrificing octane by operating reactor 12 at higher total pressures ($P_T$) than similar conventional desulfurization units. However, operating reactor 12 at this higher-than-normal total pressure ($P_T$) only yields these desulfurization and octane advantages if the hydrogen partial pressure ($P_H$) of reactor 12 is maintained at a significantly lower value than would normally be employed for high-total-pressure operation of similar conventional desulfurization units. Accordingly, it has been discovered that reactor 12 is optimized when the ratio of total pressure to hydrogen partial pressure (i.e., the $P_T/P_H$ ratio) is greater than 2.5. This preferred $P_T/P_H$ ratio of greater than 2.5 is significantly higher than conventional $P_T/P_H$ ratios used to operate similar prior art desulfurization reactors. Particularly preferred values for the $P_T/P_H$ ratio are provided above in Table 2. The EXAMPLES section, below, illustrates maintaining reactor 12 at the preferred $P_T/P_H$ ratio maximizes desulfurization while minimizing octane loss.

Another aspect of the present invention concerns the discovery that a strong correlation exists between the hydrogen partial pressure ($P_H$) maintained in reactor 12 and the degree of sulfur conversion (i.e., percent desulfurization) provided by reactor 12. In particular, it has been discovered that a relatively constant degree of sulfur conversion can be provided by maintaining reactor 12 at a relatively constant hydrogen partial pressure ($P_H$). Thus, selecting the appropriate hydrogen partial pressure ($P_H$) at which to operate reactor 12 has an important impact on the degree of desulfurization provided by reactor 12.

To optimize the operation of reactor 12, lab-scale, pilot-plant, and/or commercial-scale tests can be performed on various feed streams, at various hydrogen partial pressures ($P_H$), and various $H_2$/HC ratios to determine which combination of hydrogen partial pressure ($P_H$) and $H_2$/HC ratio provides optimum desulfurization and octane retention for each feed stream. This test data can then be used to select the appropriate operating parameters for a commercial-scale desulfurization reactor. For example, in determining the appropriate operating parameters of a commercial-scale desulfurization reactor, the operator would first determine the concentration of sulfur ($S_F$) in the hydrocarbon feed to the reactor and the desired or target concentration of sulfur ($S_P$) in the hydrocarbon product exiting the reactor. This would set the desired degree of desulfurization for the desulfurization reactor. The "degree of desulfurization" is simply the sulfur conversion, calculated as $(S_F-S_P)/S_F\times100\%$. The desired/target degree of desulfurization for a commercial desulfurization reactor is typically dictated by the required sulfur standards for the hydrocarbon product and/or the economics of the unit. Once the feed composition and desired/target degree of desulfurization for the commercial process have been determined, the test data can then be analyzed to determine the hydrogen partial pressure ($P_H$) value that yielded the desired degree of desulfurization for that type of feed. After the hydrogen partial pressure ($P_H$) value has been selected, the appropriate $H_2$/HC ratio can be determined by identifying from the test data the $H_2$/HC ratio that was employed at the selected hydrogen partial pressure ($P_H$) and that yielded the optimum desulfurization and octane retention for the selected type of feed. Once the hydrogen partial pressure ($P_H$) and $H_2$/HC ratio have been selected, the total pressure ($P_T$) can be easily calculated in any manner readily known to those skilled in the art. The remaining operating parameters of reactor 12 can be selected from the preferred ranges given above in Table 2.

A further aspect of the present invention concerns the discovery that the most important operating parameters of desulfurization reactor 12 can be determined based solely on the feed sulfur ($S_F$) and the desired/target product sulfur ($S_P$). Accordingly, it has been discovered that under preferred operating conditions a calculated optimum hydrogen partial pressure value ($P_{Hcalc}$) can be determined by the following relationship:

$$P_{Hcalc} = 0.256\times[206+0.11(S_F-125)]^{\left(\frac{25}{S_P}\right)^{0.04}}$$

wherein $S_F$ is the concentration (ppmw) of sulfur in the hydrocarbon component of the feed stream introduced into reactor 12, $S_P$ is the desired/target concentration of sulfur (ppmw) in the hydrocarbon component of the product stream exiting reactor 12, and the calculated optimum hydrogen partial pressure value ($P_{Hcalc}$) is expressed in pounds per square inch absolute (psia).

Once the calculated optimum hydrogen partial pressure ($P_{Hcalc}$) has been determined, the actual hydrogen partial pressure ($P_H$) at which reactor 12 is to be maintained during operation is preferably set within about 50 percent of $P_{Hcalc}$, more preferably within about 25 percent of $P_{Hcalc}$, and most preferably within 10 percent of $P_{Hcalc}$. After using the above-described method to determine the operating hydrogen partial pressure ($P_H$) for reactor 12, the total pressure ($P_T$) at which reactor 12 will be operated can be calculated in accordance with the preferred $P_T/P_H$ ratios set forth above in Table 2. Thus, in one aspect of the present invention, it is critical that a $P_T/P_H$ ratio of at least 2.5 is used to calculate total pressure ($P_T$) from the hydrogen partial pressure ($P_H$). After hydrogen partial pressure ($P_H$) and total pressure ($P_T$) have been determined, the $H_2$/HC ratio can be easily calculated in any manner readily known to those skilled in the art. The remaining operating parameters for reactor 12 can be selected from the preferred ranges given above in Table 2.

Yet another aspect of the present invention concerns the discovery that in order to maintain the desired degree of sulfur conversion in reactor 12, certain operating parameters may need to be adjusted during desulfurization in response to changes in the feed composition and/or changes in other operating conditions. For example, the hydrogen stream combined with the hydrocarbon stream prior to introduction into reactor 12 can experience severe fluctuations in hydrogen purity (i.e., the mole percent of pure $H_2$ in the hydrogen stream) over time due to a number of external factors. These changes in hydrogen purity can affect the hydrogen partial pressure ($P_H$) in reactor 12. As mentioned above, there is a strong correlation between hydrogen partial pressure ($P_H$) and degree of desulfurization. Therefore, fluctuations in hydrogen purity can have a significant impact on the degree of desulfurization because the hydrogen purity fluctuations vary the hydrogen partial pressure ($P_H$), which, in turn, varies the degree of desulfurization.

Figure 2:
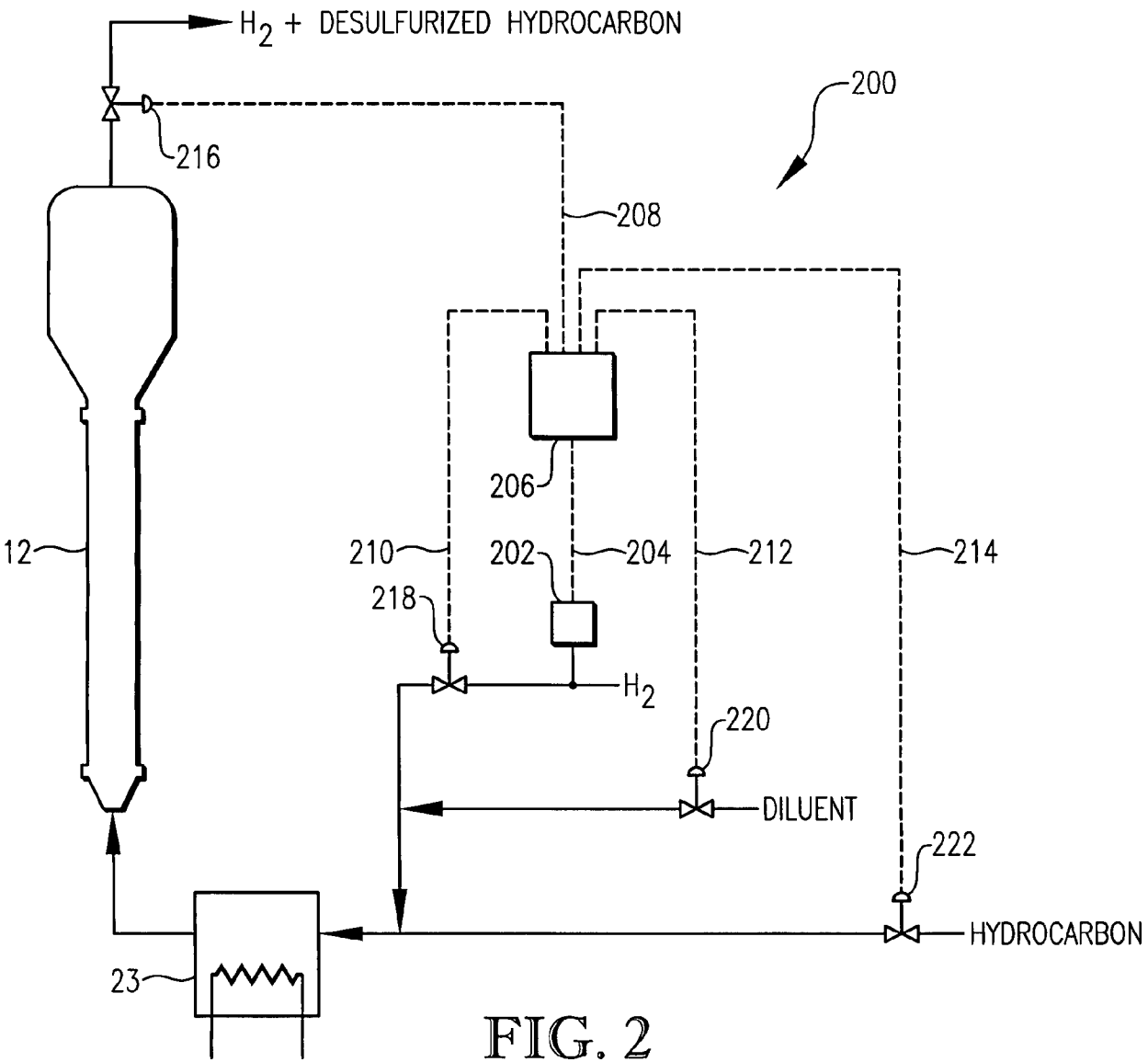
FIG. 2 is a schematic diagram of the desulfurization reactor and a control system for adjusting one or more operating parameters of the reactor to thereby maintain a substantially constant hydrogen partial pressure in the reactor.

Referring now to FIG. 2, a control system 200 is schematically illustrated in conjunction with desulfurization reactor 12. Control system 200 is operable to adjust one or more operating parameters of reactor 12. The adjustment(s) provided by control system 200 help maintain the hydrogen partial pressure ($P_H$) in reactor 12 at a substantially constant value by accounting for fluctuations in the hydrogen purity of the hydrogen stream combined with the hydrocarbon stream prior to heating in a heater 23. In heater 23, the combined stream is vaporized so that the feed introduced into reactor 12 is in a gaseous state.

If the hydrogen purity of the hydrogen stream increases, control system 200 can operated to increase total pressure ($P_T$) in reactor 12, decrease the $H_2$/HC ratio, and/or increase the addition of a diluent upstream of heater 23 in order to maintain the hydrogen partial pressure ($P_H$) in reactor 12 at a substantially constant value. On the other hand, if the hydrogen purity of the hydrogen stream decreases, control system 200 can operate to decrease the total pressure ($P_T$) in reactor 12, increase the $H_2$/HC ratio, and/or decrease the amount of diluent added upstream of heater 23 in order to maintain the hydrogen partial pressure ($P_H$) in reactor 12 at a substantially constant value.

Referring again to FIG. 2, in one embodiment, control system 200 includes a hydrogen purity monitor 202 that analyzes a sample of the hydrogen stream and generates a hydrogen purity signal 204 indicative of the amount of pure hydrogen in the hydrogen stream. A processor 206 receives the hydrogen purity signal 204 and compares it to a pre-set desired hydrogen purity range. When the hydrogen purity signal 204 indicates that the hydrogen purity of the hydrogen stream is outside the pre-set desired hydrogen purity range, the processor generates and outputs one or more control signals 208, 210, 212, and 214. Control system 200 can include one or more control devices for receiving the control signals and making the operating parameter adjustments necessary to maintain the hydrogen partial pressure ($P_H$) in reactor 12 within the desired range. Preferred control devices can include, for example, one or more of the following: a pressure control valve 216; a hydrogen control valve 218; a diluent control valve 220; and/or a hydrocarbon control valve 222. These control valves 216-222 can be used alone or in combination to make the adjustments necessary to maintain a substantially constant hydrogen partial pressure ($P_H$) in reactor 12.

Pressure control valve 216 is located at the outlet of reactor 12 and automatically adjusts in response to pressure control signal 208 to thereby vary the total pressure ($P_T$) in reactor 12. Hydrogen control valve 218 is positioned upstream of the location where the hydrogen steam and the hydrocarbon stream are combined. Hydrogen control valve 218 automatically adjusts the flow rate of the hydrogen stream in response to hydrogen control signal 210 to thereby vary the $H_2$/HC ratio of the feed to reactor 12. Hydrocarbon control valve 220 is positioned upstream of the location where the hydrogen steam and the hydrocarbon stream are combined. Hydrocarbon control valve 220 automatically adjusts the flow rate of the hydrocarbon stream in response to hydrocarbon control signal 214 to thereby vary the $H_2$/HC ratio of the feed to reactor 12.

FIG. 2 illustrates a diluent control valve 220 that controls the amount of a diluent added to the hydrogen stream prior to combining the hydrogen and hydrocarbon streams. Although all possible configurations are not fully illustrated in FIG. 2, it should be understood that the diluent can be added to the hydrocarbon stream, the hydrogen stream, and/or the combined hydrogen/hydrocarbon stream at any location upstream of heater 23. An increase in the amount of diluent added to the hydrogen, hydrocarbon, and/or combined hydrogen/hydrocarbon streams lowers the $H_2$/HC ratio of the feed to reactor 12, while a decrease in the amount of added diluent increases the $H_2$/HC ratio of the feed to reactor 12. Thus, diluent control valve 220 automatically adjusts the flow rate of the diluent stream in response to diluent control signal 212 to thereby vary the $H_2$/HC ratio and/or hydrogen purity of the feed to reactor 12.

It is preferred for the concentration of pure hydrogen ($H_2$) in the diluent stream to be substantially less than the hydrogen purity of the hydrogen stream. Most preferably, the concentration of pure hydrogen ($H_2$) in the diluent stream is less than about 10 mole percent, and most preferably less than 1 mole percent. It is preferred for the diluent to be a gas at standard temperature and pressure (STP) so as to allow for easy separation of the diluent from the hydrocarbon after desulfurization in reactor 12. It is further preferred for the diluent to be substantially inert with respect to the reaction(s) taking place in reactor 12. A particularly preferred diluent comprises at least about 50 mole percent nitrogen, more preferably at least 90 mole percent nitrogen. However, various gaseous hydrocarbon-containing refinery recycle streams may also be effectively employed as the diluent.

In operation, a target hydrogen partial pressure ($P_{HT}$) can be selected based on previous testing and/or the $P_{Hcalc}$ equation, described above. Control system 200 preferably maintains the actual hydrogen partial pressure ($P_H$) in reactor 12 within about 10 percent of the target hydrogen partial pressure ($P_{HT}$), more preferably within 5 percent of the target hydrogen partial pressure ($P_{HT}$). Control system 200 is operable to maintain the actual hydrogen partial pressure ($P_H$) in reactor 12 at a substantially constant value, even if the hydrogen purity of the hydrogen stream varies by more than 5, 10, or even 20 percent. Preferably, control system 200 is operable to prevent the hydrogen partial pressure ($P_H$) in reactor 12 from varying by more than about +/−10 percent over time. Most preferably, control system 200 prevents $P_H$ from varying by more than +/−5 percent over time.

Figure 4:
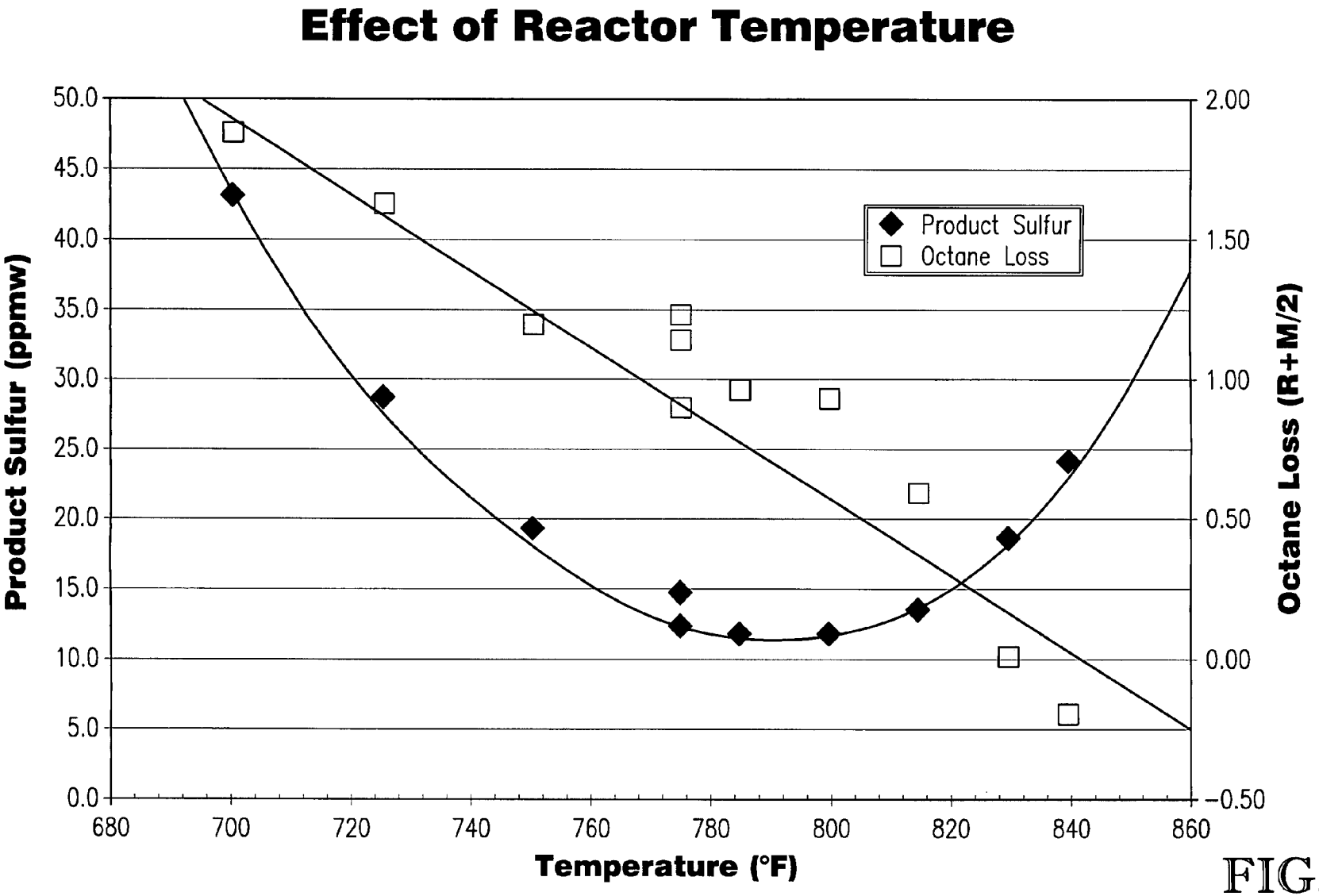
FIG. 4 is a graph plotting product sulfur and octane loss as a function of desulfurization temperature for the tests described in Example 3, below.

Still another aspect of the present invention concerns a discovery that the operating temperature of reactor 12 can be critical to optimizing sulfur removal and octane retention. Conventional wisdom indicates that as the temperature in reactor 12 is increased, both sulfur conversion and olefin conversion should increase. It is well known that an increase in olefin conversion typically results in octane loss. Thus, conventional thought is that the selection of an operating temperature for reactor 12 would necessarily be a compromise between sulfur removal and octane retention. However, we have unexpectedly discovered that sulfur conversion increases up to a certain, relatively narrow temperature range, and then decreases. Thus, as illustrated in FIG. 4, maximum sulfur removal is only provided within a specific "sweet-spot" temperature range (about 770-830° F.). In addition, we have unexpectedly discovered that octane loss decreases as desulfurization temperature increases. As mentioned above, this decrease in octane loss with increased temperature is unexpected because olefin conversion and octane loss typically increase with increasing temperature. Thus, operating near the upper limit of the identified sweet-spot temperature range optimizes both sulfur removal and octane retention. Table 2, above, provides preferred temperature values for reactor 12.

After desulfurization, the product exiting reactor 12 can be separated into its hydrogen and desulfurized hydrocarbon components by pressure reduction and/or cooling so that the desulfurized hydrocarbons, preferably desulfurized gasoline, are liquefied while the hydrogen remains as a gas. The resulting liquefied, desulfurized hydrocarbon preferably comprises less than about 50 weight percent of the amount of sulfur in the sulfur-containing hydrocarbon (e.g., cracked-gasoline) component of the feed charged to the reaction zone, more preferably less than about 20 weight percent of the amount of sulfur in the sulfur-containing hydrocarbon, and most preferably less than 5 weight percent of the amount of sulfur in the sulfur-containing hydrocarbon. The desulfurized hydrocarbon preferably comprises less than about 50 ppmw sulfur, more preferably less than about 30 ppmw sulfur, still more preferably less than about 15 ppmw sulfur, and most preferably less than 10 ppmw sulfur. It is further preferred for the desulfurized hydrocarbon to have an octane number that is not more than about 2 less than the octane of the original sulfur-containing hydrocarbon charged to the reaction zone, more preferably not more than about 1 less, and most preferably not more than 0.5 less. When octane-enhancing catalyst particles are employed in reactor 12, the octane of the desulfurized hydrocarbon product may actually be greater than the octane of the sulfur-containing hydrocarbon feed. One advantage of the inventive desulfurization system is that the octane of the sulfur-containing hydrocarbon is maintained with minimal liquid volume loss. Liquid volume loss is typically attributable to the conversion of the hydrocarbon-containing (e.g., cracked-gasoline) feed to light hydrocarbons that exist in a gaseous state at standard temperature and pressure (STP). Preferably, at least 95 percent of the liquid volume of the hydrocarbon feed is retained, more preferably at least 97 percent, still more preferably at least 98 percent, and most preferably at least 99 percent.

After desulfurization in reactor 12, at least a portion of the solid particulate system (i.e., the sulfur-loaded sorbent particles and, optionally, the coked catalyst particles) are transported to regenerator 14 via a first transport assembly 18. In regenerator 14, the solid particulate system is contacted with an oxygen-containing regeneration stream. The oxygen-containing regeneration stream preferably comprises at least one mole percent oxygen with the remainder being a gaseous diluent. More preferably, the oxygen-containing regeneration stream comprises in the range of from about one to about 50 mole percent oxygen and in the range of from about 50 to about 95 mole percent nitrogen, still more preferably in the range of from about 2 to about 20 mole percent oxygen and in the range of from about 70 to about 90 mole percent nitrogen, and most preferably in the range of from 3 to 21 mole percent oxygen and in the range of from 75 to 85 mole percent nitrogen.

The regeneration conditions in regenerator 14 are sufficient to convert at least a portion of the zinc sulfide of the sulfur-loaded sorbent particles into zinc oxide via contacting with the oxygen-containing regeneration stream, thereby removing sulfur from the sorbent particles. In addition, when the solid particulate system includes octane-enhancing catalyst particles, the regeneration conditions are sufficient to remove at least a portion of the coke from the catalyst particles. The preferred ranges for such regeneration conditions are provided below in Table 3.

TABLE 3

| | Regeneration Conditions | | |
|---|---|---|---|
| Range | Temp. (° F.) | Press. (psig) | Superficial Vel. (ft/s) |
| Preferred | 500-1500 | 10-250 | 0.5-10 |
| More Preferred | 700-1200 | 20-150 | 1.0-5.0 |
| Most Preferred | 900-1100 | 30-75 | 2.0-2.5 |

When the sulfur-loaded solid sorbent particles are contacted with the oxygen-containing regeneration stream under the regeneration conditions described above, at least a portion of the promoter metal component is oxidized to form an oxidized promoter metal component. Preferably, in regenerator 14 the substitutional solid metal solution ($M_AZn_B$) and/or sulfided substitutional solid metal solution ($M_AZn_BS$) of the sulfur-loaded sorbent is converted to a substitutional solid metal oxide solution characterized by the formula: $M_XZn_YO$, wherein M is the promoter metal and X and Y are each numerical values in the range of from 0.01 to about 0.99. In the above formula, it is preferred for X to be in the range of from about 0.5 to about 0.9 and most preferably from 0.6 to 0.8. It is further preferred for Y to be in the range of from about 0.1 to about 0.5, and most preferably from 0.2 to 0.4. Preferably, Y is equal to (1−X).

The regenerated solid particulate system exiting regenerator 14 preferably comprises substantially sulfur-free sorbent particles and, optionally, substantially coke-free catalyst particles. The substantially sulfur-free sorbent particles can comprise zinc oxide, the oxidized promoter metal component ($M_XZn_YO$), the porosity enhancer (PE), and the promoter metal-zinc aluminate ($M_ZZn_{(1-Z)}Al_2O_4$) in the ranges provided below in Table 4.

TABLE 4

Components of the Regenerated Solid Sorbent Particulates

| Range | ZnO (wt %) | $M_XZn_YO$ (wt %) | PE (wt %) | $M_ZZn_{(1-Z)}Al_2O_4$ (wt %) |
|---|---|---|---|---|
| Preferred | 5-80 | 5-70 | 2-50 | 1-50 |
| More Preferred | 20-60 | 15-60 | 5-30 | 5-30 |
| Most Preferred | 30-50 | 20-40 | 10-20 | 10-20 |

After regeneration in regenerator 14, the regenerated solid particulate system is transported to reducer 16 via a second transport assembly 20. In reducer 16, the regenerated solid particles are contacted with a hydrogen-containing reducing stream. The hydrogen-containing reducing stream preferably comprises at least about 50 mole percent hydrogen with the remainder being cracked hydrocarbon products such as, for example, methane, ethane, and propane. More preferably, the hydrogen-containing reducing stream comprises about 70 mole percent hydrogen, and most preferably at least 80 mole percent hydrogen. The reducing conditions in reducer 16 are sufficient to reduce the valence of the oxidized promoter metal component of the regenerated solid sorbent particles. The preferred ranges for such reducing conditions are provided below in Table 5.

TABLE 5

Reducing Conditions

| Range | Temp. (° F.) | Press. (psig) | Superficial Vel. (ft/s) |
|---|---|---|---|
| Preferred | 250-1250 | 25-750 | 0.1-4.0 |
| More Preferred | 600-1000 | 100-400 | 0.2-2.0 |
| Most Preferred | 750-850 | 150-250 | 0.3-1.0 |

When the regenerated solid sorbent particles are contacted with the hydrogen-containing reducing stream in reducer 16 under the reducing conditions described above, at least a portion of the oxidized promoter metal component is reduced to form the reduced-valence promoter metal component. Preferably, at least a substantial portion of the substitutional solid metal oxide solution ($M_XZn_YO$) is converted to the reduced-valence promoter metal component ($M_AZn_B$).

After the solid particulate system has been reduced in reducer 16, it can be transported back to reactor 12 via a third transport assembly 22 for recontacting with the hydrocarbon-containing fluid stream in reactor 12.

Referring again to FIG. 1, first transport assembly 18 generally comprises a reactor pneumatic lift 24, a reactor receiver 26, and a reactor lockhopper 28 fluidly disposed between reactor 12 and regenerator 14. During operation of desulfurization unit 10 the sulfur-loaded sorbent particles and coked catalyst particles are continuously withdrawn from reactor 12 and lifted by reactor pneumatic lift 24 from reactor 12 to reactor receiver 18. Reactor receiver 18 is fluidly coupled to reactor 12 via a reactor return line 30. The lift gas used to transport the solid particles from reactor 12 to reactor receiver 26 is separated from the solid particles in reactor receiver 26 and returned to reactor 12 via reactor return line 30. Reactor lockhopper 26 is operable to transition the solid particles from the high pressure hydrocarbon environment of reactor 12 and reactor receiver 26 to the low pressure oxygen environment of regenerator 14. To accomplish this transition, reactor lockhopper 28 periodically receives batches of the solid particles from reactor receiver 26, isolates the particles from reactor receiver 26 and regenerator 14, and changes the pressure and composition of the environment surrounding the particles from a high pressure hydrocarbon environment to a low pressure inert (e.g., nitrogen) environment. After the environment of the solid particles has been transitioned, as described above, the particles are batch-wise transported from reactor lockhopper 28 to regenerator 14. Because the solid particles are continuously withdrawn from reactor 12 but processed in a batch mode in reactor lockhopper 28, reactor receiver 26 functions as a surge vessel wherein the solid particles continuously withdrawn from reactor 12 can be accumulated between transfers of the particles from reactor receiver 26 to reactor lockhopper 28. Thus, reactor receiver 26 and reactor lockhopper 28 cooperate to transition the flow of the solid particles between reactor 12 and regenerator 14 from a continuous mode to a batch mode.

Second transport assembly 20 generally comprises a regenerator pneumatic lift 32, a regenerator receiver 34, and a regenerator lockhopper 36 fluidly disposed between regenerator 14 and reducer 16. During operation of desulfurization unit 10 the regenerated sorbent and catalyst particles are continuously withdrawn from regenerator 14 and lifted by regenerator pneumatic lift 32 from regenerator 14 to regenerator receiver 34. Regenerator receiver 34 is fluidly coupled to regenerator 14 via a regenerator return line 38. The lift gas used to transport the regenerated particles from regenerator 14 to regenerator receiver 34 is separated from the regenerated particles in regenerator receiver 34 and returned to regenerator 14 via regenerator return line 38. Regenerator lockhopper 36 is operable to transition the regenerated particles from the low pressure oxygen environment of regenerator 14 and regenerator receiver 34 to the high pressure hydrogen environment of reducer 16. To accomplish this transition, regenerator lockhopper 36 periodically receives batches of the regenerated particles from regenerator receiver 34, isolates the regenerated particles from regenerator receiver 34 and reducer 16, and changes the pressure and composition of the environment surrounding the regenerated particles from a low pressure oxygen environment to a high pressure hydrogen environment. After the environment of the regenerated particles has been transitioned, as described above, the regenerated particles are batch-wise transported from regenerator lockhopper 36 to reducer 16. Because the regenerated sorbent and catalyst particles are continuously withdrawn from regenerator 14 but processed in a batch mode in regenerator lockhopper 36, regenerator receiver 34 functions as a surge vessel wherein the particles continuously withdrawn from regenerator 14 can be accumulated between transfers of the regenerated particles from regenerator receiver 34 to regenerator lockhopper 36. Thus, regenerator receiver 34 and regenerator lockhopper 36 cooperate to transition the flow of the regenerated particles between regenerator 14 and reducer 16 from a continuous mode to a batch mode.

The following examples are intended to be illustrative of the present invention and to teach one of ordinary skill in the art to make and use the invention. These examples are not intended to limit the invention in any way.

EXAMPLES

Figure 3:
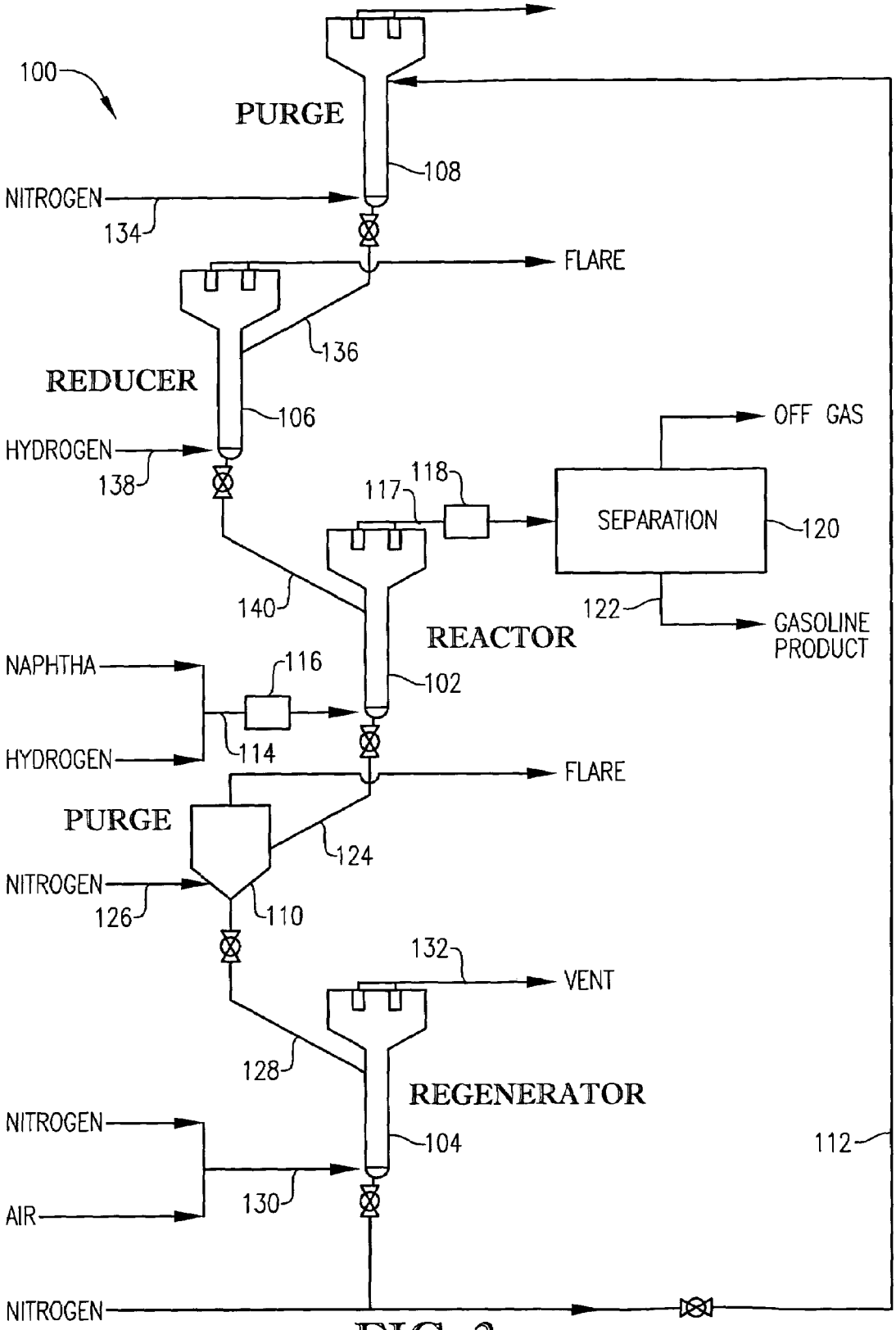
FIG. 3 is a schematic diagram of a pilot plant used to perform the desulfurization tests summarized in the EXAMPLES section, below.

Tests performed in the pilot plant schematically illustrated in FIG. 3. Referring now to FIG. 3, pilot plant 100 generally includes a reactor 102, a regenerator 104, and a reducer 106. Solid sorbent particles having a mean particle size of about 70 microns were continuously circulated from the reactor 102, to the regenerator 104, to the reducer 106, and back to the reactor 102.

The sorbent particles employed in the pilot plant 100 comprised an unbound mixture of two different types of sorbents. The two types of sorbents are referred to herein as "Generation 2" and "Generation 3" sorbents. The base microspheres of the Generation 2 sorbent were formed by spray-drying and calcining a mixture of approximately 18 weight percent expanded perlite (Sil-Kleer™ 27M, available from Silbrico Corporation, Hodgkins, Ill.), 17 weight percent of aluminum hydroxide (Dispal® Aluminum Powder, available from CONDEA Vista Company, Houston, Tex.), and 65 weight percent zinc oxide (available from Zinc Corporation, Monaca, Pa.). The base microspheres of the Generation 3 sorbent were formed by spray-drying and calcining a mixture of approximately 22 weight percent expanded perlite (Harborlite™ 205, available from Harborlite Corporation, Antonio, Colo.), 21 weight percent aluminum hydroxide (Dispal®), and 57 weight percent zinc oxide powder (from Zinc Corporation). After spray-drying and calcining, the Generation 2 and 3 base microspheres were impregnated with nickel nitrate hexahydrate to a target nickel loading of 18 weight percent nickel metal and thereafter calcined to decompose the nitrate. The actual concentration of nickel metal on the final Generation 2 and Generation 3 sorbents employed in the pilot plant 100 was approximately 16.5 weight percent nickel. The unbound sorbent mixture employed in the pilot plant 100 included about 33 percent (by weight) Generation 2 sorbent and about 67 percent Generation 3 sorbent.

In reactor 102, the solid sorbent particles (Generation 2/3 sorbent mixture) were continuously contacted with the various hydrocarbon-containing feed streams (described in detail in each of the following examples) to thereby remove sulfur from the feed streams and provide sulfur-loaded sorbent particles. The sulfur-loaded sorbent particles were continuously transported from the reactor 102 to a purge vessel 110 via conduit 124 at a constant sorbent circulation rate of 2.57 g/min. The sulfur-loaded sorbent exiting the reactor 102 had a sulfur loading of approximately 5-7 weight percent. In the purge vessel 110, the sulfur-loaded sorbent particles were purged with nitrogen introduced via conduit 126. The purged, sulfur-loaded sorbent particles were transported from the purge vessel 110 to the regenerator 104 via conduit 128. In the regenerator 104, the sorbent particles were contacted with a mixture of nitrogen and air introduced via conduit 130. The nitrogen and air were charged to the regenerator 104 at a rate of 100 l/min and 1.7 l/min, respectively. The temperature in the regenerator 104 was maintained at about 1,025° F., and the pressure was maintained at about 223 psig. In the regenerator 104, the sorbent particles were oxidized for removal sulfur as sulfur dioxide, which exited the regenerator 104 via conduit 132. The regenerated sorbent withdrawn from the regenerator 104 had a sulfur loading of about 1-2 weight percent sulfur. Thus, a net sulfur loading of about 4-6 weight percent was achieved in all the tests performed in the pilot plant 100.

The regenerated sorbent particles were transported from the regenerator 104 to a purge vessel 108 via a pneumatic lift 112. In the purge vessel 108, the regenerated sorbent particles were purged with nitrogen introduced via conduit 134. The purged, regenerated sorbent particles were then transported to the reducer 106 via conduit 136. In the reducer 106, the regenerated sorbent particles were contacted with a hydrogen stream introduced via conduit 138. The hydrogen stream was charged to the reducer 106 at a rate of about 120 l/min. The temperature and pressure in the reducer were maintained at about 750° F. and 225 psia. After reduction in the reducer 106, the reduced (activated) sorbent was transported via conduit 140 for re-introduction into the reactor 102.

Example 1

Pressure Effect

In this example, the above-described pilot plant was used to conduct desulfurization tests. The desulfurization tests were grouped into nine cases (A-I), with each case having several different runs. Cases A-I all employed similar desulfurization temperatures of about 770-775° F. Cases A-D each employed the same as a full range FCC gasoline having an initial sulfur content of 533 ppmw. However, Cases E-I each employed a different full range FCC gasoline feed, with the feed employed in Cases E, F, G, H, and I having an initial sulfur concentration of 553, 531, 700, 500, and 1988 ppmw, respectively. Cases A-C and E-I each employed the above-described Generation 2/3 sorbent mixture, while Case D employed only Generation 2 sorbent particles.

The desulfurization tests of this example investigated the effect of varying the hydrogen-to-hydrocarbon molar ratio ($H_2$/HC) and the ratio of total pressure to hydrogen partial pressure ($P_T/P_H$) at constant hydrogen partial pressures ($P_H$). In Case A, hydrogen partial pressure ($P_H$) was maintained at 90 psia for six runs (A1-A6) at various $H_2$/HC and $P_T/P_H$ ratios. In Case B, hydrogen partial pressure ($P_H$) was maintained at 80 psia for six runs (B1-B6) at various $H_2$/HC and $P_T/P_H$ ratios. In Case C, hydrogen partial pressure ($P_H$) was maintained at 67 psia for four runs (C1-C4) at various $H_2$/HC and $P_T/P_H$ ratios. In Case D, hydrogen partial pressure ($P_H$) was maintained at 72 psia for four runs (D1-D4) at various $H_2$/HC and $P_T/P_H$ ratios. In Case E, hydrogen partial pressure ($P_H$) was maintained at about 71 psia for four runs (E1-E4) at various $H_2$/HC and $P_T/P_H$ ratios. In Case F, hydrogen partial pressure ($P_H$) was maintained at about 87 psia for two runs (F1-F2) at various $H_2$/HC and $P_T/P_H$ ratios. In Case G, hydrogen partial pressure ($P_H$) was maintained at about 88 psia for two runs (G1-G2) at various $H_2$/HC and $P_T/P_H$ ratios. In Case H, hydrogen partial pressure ($P_H$) was maintained at 54 psia for two runs (H1-H2) at various $H_2$/HC and $P_T/P_H$ ratios. In Case I, hydrogen partial pressure ($P_H$) was maintained at 118 psia for two runs (I1-I2) at various $H_2$/HC and $P_T/P_H$ ratios.

In each case (A-I), the sulfur content and octane number ([R+M]/2) of the desulfurized hydrocarbon product was measured. Percent desulfurization and octane loss values were computed from the measured product sulfur and product octane values so that the effect of varying $H_2$/HC and $P_T/P_H$ ratios at constant hydrogen partial pressure ($P_H$) could be readily studied.

In addition, the desulfurization tests of this example investigated our ability to calculate an optimum hydrogen partial pressure value ($P_{Hcalc}$) from feed sulfur ($S_F$) and desired/target product sulfur ($S_P$) based on the following equation:

$$P_{Hcalc} = 0.256 \times [206 + 0.11(S_F - 125)]^{\left(\frac{25}{S_P}\right)^{0.04}}$$

where $S_F$ and $S_P$ are expressed in ppmw and $P_{Hcalc}$ is expressed in psia.

Tables 6a, 6b, and 6c, below, summarize the results for the desulfurization tests of Cases A-B, C-D, and E-I, respectively.

TABLE 6a

Pressure Effect - Test Data

| | Case - Run | | | | | | | | | | | |
|---|---|---|---|---|---|---|---|---|---|---|---|---|
| | A1 | A2 | A3 | A4 | A5 | A6 | B1 | B2 | B3 | B4 | B5 | B6 |
| Feed Sulfur (ppmw) | 550 | 550 | 550 | 550 | 550 | 550 | 550 | 550 | 550 | 550 | 550 | 550 |
| WHSV ($hr^{-1}$) | 6 | 6 | 6 | 6 | 6 | 6 | 5 | 5 | 5 | 5 | 5 | 5 |
| $H_2$/HC Ratio (molar) | 1.21 | 0.72 | 0.6 | 0.45 | 0.38 | 0.35 | 0.95 | 0.73 | 0.5 | 0.38 | 0.32 | 0.3 |
| Temperature (F.) | 775 | 775 | 775 | 775 | 775 | 775 | 775 | 775 | 775 | 775 | 775 | 775 |
| Total Pressure (psia) | 165 | 215 | 240 | 290 | 330 | 347 | 165 | 215 | 240 | 290 | 330 | 347 |
| $H_2$ Part Press (psia) | 90 | 90 | 90 | 90 | 90 | 90 | 80 | 80 | 80 | 80 | 80 | 80 |
| Total P/$H_2$ Part Press ($P_T/P_h$) | 1.83 | 2.39 | 2.66 | 3.22 | 3.67 | 3.86 | 2.06 | 2.68 | 3.00 | 3.62 | 4.13 | 4.34 |
| Product Sulfur (ppmw) | 28.4 | 18.2 | 13.3 | 10.1 | 7.3 | 8.4 | 25 | 17.3 | 11.1 | 8.3 | 8.3 | 9.5 |
| Desulfurization (%) | 95% | 97% | 98% | 98% | 99% | 98% | 95% | 97% | 98% | 98% | 98% | 98% |
| Octane Loss ([R + M]/2) | 0.83 | 1.08 | 1.02 | 1.02 | 0.89 | 0.63 | 0.89 | 1.03 | 0.58 | 0.47 | 0.49 | 0.66 |
| Target Prod. Sulfur (ppmw) | 7.5 | 7.5 | 7.5 | 7.5 | 7.5 | 7.5 | 7.5 | 7.5 | 7.5 | 7.5 | 7.5 | 7.5 |
| Calc $H_2$ Part Press (psia) | 84.4 | 84.4 | 84.4 | 84.4 | 84.4 | 84.4 | 84.4 | 84.4 | 84.4 | 84.4 | 84.4 | 84.4 |
| Diff. $P_{Hcalc}$ & $P_{Hact}$ (%) | 6% | 6% | 6% | 6% | 6% | 6% | −5% | −5% | −5% | −5% | −5% | −5% |

TABLE 6b

Pressure Effect - Test Data

| | Case - Run | | | | | | | |
|---|---|---|---|---|---|---|---|---|
| | C1 | C2 | C3 | C4 | D1 | D2 | D3 | D4 |
| Feed Sulfur (ppmw) | 550 | 550 | 550 | 550 | 553 | 553 | 553 | 553 |
| WHSV ($hr^{-1}$) | 4.5 | 4.5 | 4.5 | 4.5 | 5 | 5 | 5 | 5 |
| $H_2$/HC Ratio (molar) | 0.45 | 0.38 | 0.25 | 0.23 | 0.77 | 0.5 | 0.37 | 0.29 |
| Temperature (F.) | 775 | 775 | 775 | 775 | 770 | 770 | 770 | 770 |
| Total Pressure (psia) | 164 | 190 | 278 | 308 | 165 | 215 | 265 | 315 |
| $H_2$ Part Press (psia) | 67 | 67 | 67 | 67 | 72 | 72 | 72 | 72 |
| Total P/$H_2$ Part Press ($P_T/P_h$) | 2.45 | 2.84 | 4.16 | 4.60 | 2.29 | 2.98 | 3.68 | 4.37 |
| Product Sulfur (ppmw) | 22 | 17.3 | 14.6 | 13.2 | 54.9 | 34 | 32.5 | 37.5 |
| Desulfurization (%) | 96% | 97% | 97% | 98% | 90% | 94% | 94% | 93% |
| Octane Loss ([R + M]/2) | 0.51 | 0.63 | 0.6 | 0.49 | 0.36 | 0.47 | 0.18 | 0.11 |
| Target Prod. Sulfur (ppmw) | 15 | 15 | 15 | 15 | 30 | 30 | 30 | 30 |
| Calc $H_2$ Part Press (psia) | 72.0 | 72.0 | 72.0 | 72.0 | 61.7 | 61.7 | 61.7 | 61.7 |
| Diff. $P_{Hcalc}$ & $P_{Hact}$ (%) | −7% | −7% | −7% | −7% | 14% | 14% | 14% | 14% |

TABLE 6c

Pressure Effect - Test Data

| | Case - Run | | | | | | | | | | | |
|---|---|---|---|---|---|---|---|---|---|---|---|---|
| | E1 | E2 | E3 | E4 | F1 | F2 | G1 | G2 | H1 | H2 | I1 | I2 |
| Feed Sulfur (ppmw) | 553 | 553 | 553 | 553 | 531 | 531 | 700 | 700 | 500 | 500 | 1988 | 1988 |
| WHSV ($hr^{-1}$) | 5 | 5 | 5 | 5 | 5.6 | 5.6 | 4 | 4 | 5.6 | 5.6 | 3.0 | 3.0 |
| $H_2$/HC Ratio (molar) | 0.77 | 0.5 | 0.37 | 0.29 | 0.49 | 0.38 | 0.7 | 0.5 | 0.5 | 0.5 | 0.7 | 0.7 |
| Temperature (F.) | 770 | 770 | 770 | 770 | 776 | 776 | 775 | 775 | 776 | 776 | 775 | 775 |
| Total Pressure (psia) | 165 | 215 | 265 | 315 | 265 | 315 | 215 | 265 | 165 | 265 | 287 | 340 |
| $H_2$ Part Press (psia) | 71.6 | 71.5 | 70.7 | 71.7 | 87.1 | 86.7 | 88.2 | 88.4 | 54.0 | 54.0 | 118.0 | 118.0 |
| Total P/$H_2$ Part Press ($P_T/P_h$) | 2.30 | 3.00 | 3.74 | 4.39 | 3.04 | 3.63 | 2.43 | 2.99 | 3.05 | 4.90 | 2.43 | 2.88 |
| Product Sulfur (ppmw) | 54.9 | 34 | 32.5 | 37.5 | 13.1 | 9.3 | 22.5 | 17 | 18.4 | 14.5 | 12.4 | 9.1 |
| Desulfurization (%) | 90% | 94% | 94% | 93% | 98% | 98% | 97% | 98% | 96% | 97% | 99% | 99% |
| Octane Loss ([R + M]/2) | 0.36 | 0.47 | 0.18 | 0.11 | 0.14 | 0.08 | 0.77 | 0.60 | 0.3 | 0.15 | 1.90 | 2.00 |
| Target Prod. Sulfur (ppmw) | 20 | 20 | 20 | 20 | 10 | 10 | 15 | 15 | 15 | 15 | 15 | 15 |
| Calc $H_2$ Part Press (psia) | 68.1 | 68.1 | 68.1 | 68.1 | 78.9 | 78.9 | 77.4 | 77.4 | 70.9 | 70.9 | 119.1 | 119.1 |
| Diff. $P_{Hcalc}$ & $P_{Hact}$ (%) | 5% | 5% | 4% | 5% | 9% | 9% | 12% | 12% | −31% | −31% | −1% | −1% |

Tables 6a-c, above, show that desulfurization and octane retention are enhanced at higher ratios of total pressure to hydrogen partial pressure ($P_T/P_H$), especially when $H_2$/HC ratios are maintained at lower values. In particular, the desulfurization test results indicate that all tests employing $P_T/P_H$ ratios above 2.5 and $H_2$/HC ratios below 0.7 consistently provided excellent desulfurization and octane retention. In addition, tests employing $P_T/P_H$ ratios of 3-6 and $H_2$/HC ratios of 0.2-0.5 consistently provided the best rates of desulfurization and the least octane loss.

Tables 6a-c also show that the above-identified equation for calculating an optimum hydrogen partial pressure valve ($P_{Hcalc}$) from feed sulfur ($S_F$) and desired/target product sulfur ($S_P$) is very accurate when the optimum $H_2$/HC and $P_T/P_H$ ratios, identified above, are employed. For example, in Cases A and B, the equation for calculating the optimum hydrogen partial pressure valve ($P_{Hcalc}$) from feed sulfur ($S_F$) and desired/target product sulfur ($S_P$) yielded a $P_{Hcalc}$ value of 84.4 psia when a target product sulfur ($S_P$) of 7.5 ppmw was determined for the feed, which had an initial feed sulfur ($S_F$) of 533 ppmw. The desulfurization tests of Cases A and B were run at actual hydrogen partial pressures values ($P_H$) of 90 and 80 psia, respectively. Thus, Cases A and B employed actual hydrogen partial pressures ($P_H$) that were slightly higher and slightly lower than the calculated optimum hydrogen partial pressure value ($P_{Hcalc}$) of 84.4 psia. As shown in Table 6a, runs A4-A6 and B3-B6 of Cases A and B employed the optimum $H_2$/HC and $P_T/P_H$ ratios identified above. The accuracy and effectiveness of the equation for calculating the optimum hydrogen partial pressure value ($P_{Hcalc}$) from actual feed sulfur ($S_F$) and target product sulfur ($S_P$) is verified by the product sulfur values in runs A4-A6 and B3-B6 (which are very close to the desired/target product sulfur ($S_P$) used to calculate $P_{Hcalc}$ and the relatively low octane loss values in runs A4-A6 and B3-B6.

Example 2

Hydrogen Partial Pressure Control

In this example, desulfurization tests were conducted and grouped into three cases (A-C). Cases A-C all employed a full range FCC gasoline feed having an initial sulfur content of 533 ppmw, a desulfurization temperature of 775° F., and the above-described Generation 2/3 sorbent mixture.

The desulfurization tests of this example investigated various methods of maintaining hydrogen partial pressure at a substantially constant value despite variations in the hydrogen purity of the hydrogen stream combined with the hydrocarbon stream prior to introduction into the desulfurization reactor. In Case A, hydrogen purity was varied in two runs (A1-A2), while maintaining all other operating parameters constant. In Case B, total pressure was varied along with hydrogen purity in four runs (B1-B4), while maintaining all other operating parameters constant. In Case C, hydrogen-to-hydrocarbon molar ratio ($H_2$/HC) was varied along with hydrogen purity in two runs (C1-C2), while maintaining all other operating parameters constant. Table 7, below, summarizes the results for the desulfurization tests of Cases A-C.

TABLE 7

Hydrogen Partial Pressure Control - Test Data

| | Case - Run | | | | | | | |
|---|---|---|---|---|---|---|---|---|
| | A1 | A2 | B1 | B2 | B3 | B4 | C1 | C2 |
| Feed Sulfur (ppmw) | 1000 | 1000 | 1000 | 1000 | 1000 | 1000 | 1000 | 1000 |
| WHSV ($hr^{-1}$) | 4.0 | 4.0 | 4.0 | 4.0 | 4.0 | 4.0 | 4.0 | 3.16 |
| $H_2$ Purity (mole % H2) | 81.8% | 60.7% | 81.8% | 60.7% | 53.0% | 45.0% | 81.8% | 60.7% |
| $H_2$/HC Ratio (molar) | 0.5 | 0.5 | 0.5 | 0.5 | 0.5 | 0.5 | 0.5 | 0.63 |
| Temperature (° F.) | 775 | 775 | 775 | 775 | 775 | 775 | 775 | 775 |
| Total Pressure (psia) | 239.7 | 239.7 | 239.7 | 273.7 | 292.7 | 319.7 | 239.7 | 239.7 |
| $H_2$ Part Press (psia) | 75 | 65.7 | 75 | 75 | 75 | 75 | 75 | 75 |
| Total P/$H_2$ Part Press ($P_T/P_h$) | 3.20 | 3.65 | 3.20 | 3.65 | 3.90 | 4.26 | 3.20 | 3.20 |
| Product Sulfur (ppmw) | 23.1 | 41.6 | 23.1 | 24.7 | 28.6 | 23.7 | 23.1 | 26 |
| Desulfurization (%) | 98% | 96% | 98% | 98% | 97% | 98% | 98% | 97% |
| Octane Loss ([R + M]/2) | 0.58 | 0.44 | 0.58 | 0.6 | 0.75 | 0.68 | 0.58 | 0.81 |
| Target Prod. Sulfur (ppmw) | 25 | 25 | 25 | 25 | 25 | 25 | 25 | 25 |
| Calc $H_2$ Part Press (psia) | 77.4 | 77.4 | 77.4 | 77.4 | 77.4 | 77.4 | 77.4 | 77.4 |
| Diff. $P_{Hcalc}$ & $P_{Hact}$ (%) | 3% | 18% | 3% | 3% | 3% | 3% | 3% | 3% |

Case A illustrates that unaccounted-for variations in hydrogen purity of the hydrogen stream significantly effect hydrogen partial pressure ($P_H$) and percent desulfurization. Case B shows that variations in hydrogen purity of the hydrogen stream can be accounted for by varying total pressure ($P_T$) in the reactor, thereby maintaining a constant hydrogen partial pressure ($P_H$) and a substantially constant percent desulfurization. Case C shows that variations in hydrogen purity of the hydrogen stream can be accounted for by varying the $H_2$/HC ratio of the feed to the reactor, thereby maintaining a constant hydrogen partial pressure ($P_H$) and a substantially constant percent desulfurization.

Example 3

Temperature Effect

In this example, desulfurization tests were conducted at various temperatures to determine the effect of temperature on desulfurization and octane loss. The desulfurization tests were conducted on a full range FCC gasoline having an initial sulfur content of 1000 ppmw sulfur. The desulfurization conditions included a total pressure of 264.7 psia, a WHSV of 4 $hr^{-1}$, and a $H_2$/HC ratio of 0.5.

FIG. 4 plots the results for the desulfurization tests of this example. Surprisingly, FIG. 4 shows that optimum sulfur conversion takes place within a specific, relatively narrow, "sweet-spot" temperature range (approximately 770-830° F.). If the desulfurization temperature is higher or lower than this sweet-spot temperature, then the system exhibits a lower degree of desulfurization. In addition, FIG. 4 surprisingly shows that octane loss decreases with increasing temperature. This trend of decreasing octane loss with increasing temperature is surprising because one would think increasing temperature would increase olefin conversion which would, in turn, increase octane loss. Thus, when it is desired to minimize octane loss while still achieving sufficient desulfurization, one may choose to operate the reactor at a temperature near the upper end of the identified sweet-spot temperature range.

Reasonable variations, modifications, and adaptations may be made within the scope of this disclosure and the appended claims without departing from the scope of this invention.

What is claimed is:

1. A desulfurization process comprising:

(a) contacting a predominantly gasoline feed stream with a sorbent in a desulfurization zone under desulfurization conditions sufficient to transfer sulfur from said feed stream to said sorbent, wherein said feed stream comprises hydrogen ($H_2$) and hydrocarbons (HC) in a $H_2$/HC molar ratio less than 0.7, wherein said desulfurization conditions include a total pressure ($P_T$) and a hydrocarbon partial pressure ($P_H$) at a $P_T/P_H$ ratio of at least 2.5, wherein said desulfurization conditions include a desulfurization temperature in the range of from about 770 to about 830° F.;

(b) contacting at least a portion of said sorbent with an oxygen containing regeneration stream in a regeneration zone; and (c) contacting at least a portion of said sorbent with a hydrogen-containing reducing stream in a reducing zone.

2. The desulfurization process according to claim 1, wherein said $H_2$/HC ratio is in the range of from about 0.2 to about 0.5.

3. The desulfurization process according to claim 1, wherein said $P_H$ is in the range of from about 50 to about 200 psia.

4. The desulfurization process according to claim 1, wherein said $P_T/P_H$ ratio is in the range of from about 3 to about 6.

5. The desulfurization process according to claim 1, wherein said $P_T/P_H$ ratio is in the range of from 3.25 to 5, wherein said $H_2$/HC molar ratio is in the range of from 0.2 to 0.5, wherein said $P_H$ is in the range of from 60 to 150 psia, wherein said $P_T$ is in the range of from 200 to 550 psia, wherein said desulfurization conditions include a desulfurization temperature in the range of from 770 to 830° F., wherein said hydrocarbons comprise gasoline and/or cracked-gasoline, wherein said hydrocarbons comprise at least 100 ppmw sulfur.

6. The desulfurization process according to claim 1, wherein said sorbent comprises zinc oxide, wherein step (a) includes converting at least a portion of said zinc oxide to zinc sulfide.

7. The desulfurization process according to claim 6, wherein step (b) includes converting at least a portion of said zinc sulfide to zinc oxide.

8. The desulfurization process according to claim 7, wherein said sorbent comprises a promoter metal component different from said zinc oxide or said zinc sulfide, wherein step (b) includes oxidizing said promoter metal component, wherein step (c) includes reducing said promoter metal component.

9. The desulfurization process according to claim 8, wherein said promoter metal component comprises one or more metals selected from the group consisting of nickel, cobalt, iron, manganese, tungsten, silver, gold, copper, platinum, zinc, tin, ruthenium, molybdenum, antimony, vanadium, iridium, chromium, and palladium.

10. The desulfurization process according to claim 8, wherein said promoter metal component comprises nickel.

11. The desulfurization process according to claim 1, wherein said desulfurization, regeneration, and reducing zones are defined by separate vessels.

12. The desulfurization process according to claim 11, further comprising:

(d) continuously transferring at least a portion of said sorbent from said desulfurization zone to said regeneration zone;

(e) continuously transferring at least a portion of said sorbent from said regeneration zone to said reducing zone; and (f) continuously transferring at least a portion of said sorbent from said reducing zone to said desulfurization zone.

13. A process for removing sulfur from a hydrocarbon-containing feed stream to thereby produce a desulfurized hydrocarbon-containing product stream, said process comprising:

(a) determining an average sulfur content ($S_F$) of the hydrocarbon components of said feed stream;

(b) determining a desired sulfur content ($S_P$) of the hydrocarbon components of said product stream; and (c) contacting said feed stream with a sorbent in a desulfurization zone under desulfurization conditions sufficient to remove sulfur from said feed stream, wherein said feed stream comprises hydrogen ($H_2$) and hydrocarbons (HC) in a $H_2$/HC molar ratio less than 0.7, wherein said desulfurization conditions include a total pressure ($P_T$) and a hydrogen partial pressure ($P_H$) at a $P_T/P_H$ ratio greater than 2.5, wherein said $P_H$ is within about 50 percent of a calculated hydrogen partial pressure valve ($P_{Hcalc}$) determined according to the following equation:

$$P_{Hcalc} = 0.256 \times [206 + 0.11(S_F - 125)]^{\left(\frac{25}{S_P}\right)^{0.04}}$$

wherein $S_F$ and $S_P$ are expressed in parts per million by weight (ppmw) and $P_{Hcalc}$ is in pounds per square inch absolute (psia).

14. The desulfurization process according to claim 13, wherein said $P_H$ is within about 25 percent of said $P_{Hcalc}$.

15. The desulfurization process according to claim 13, wherein said $S_F$ is at least about 50 ppmw and said $S_P$ is less than about 25 percent of said $S_F$.

16. The desulfurization process according to claim 13, wherein said $H_2$/HC molar ratio is in the range of from about 0.2 to about 0.5.

17. The desulfurization process according to claim 13, wherein said $P_T/P_H$ ratio is in the range of from about 3 to about 6, wherein said $P_H$ is in the range of from about 60 to about 150 psia, wherein said desulfurization conditions include a temperature in the range of from about 750 to about 850° F.

18. The process according to claim 13, further comprising:

(d) contacting at least a portion of said sorbent with an oxygen-containing regeneration stream in a regeneration zone; and (e) contacting at least a portion of said sorbent with a hydrogen-containing reducing stream in a reducing zone.

19. The desulfurization process according to claim 18, wherein said sorbent comprises zinc oxide, wherein step (c) includes converting at least a portion of said zinc oxide to zinc sulfide.

20. The desulfurization process according to claim 19, wherein step (d) includes converting at least a portion of said zinc sulfide to zinc oxide.

21. The desulfurization process according to claim 20, wherein said sorbent comprises a promoter metal component different from said zinc oxide or said zinc sulfide, wherein step (d) includes oxidizing said promoter metal component, wherein step (e) includes reducing said promoter metal component.

22. The desulfurization process according to claim 21, wherein said promoter metal component comprises one or more metals selected from the group consisting of nickel, cobalt, iron, manganese, tungsten, silver, gold, copper, platinum, zinc, tin, ruthenium, molybdenum, antimony, vanadium, iridium, chromium, and palladium.

23. The desulfurization process according to claim 21, wherein said promoter metal component comprises nickel.

24. The desulfurization process according to claim 18, wherein said desulfurization, regeneration, and reducing zones are defined by separate vessels.

25. The desulfurization process according to claim 24, further comprising:

(f) continuously transferring at least a portion of said sorbent from said desulfurization zone to said regeneration zone;

(g) continuously transferring at least a portion of said sorbent from said regeneration zone to said reducing zone; and (h) continuously transferring at least a portion of said sorbent from said reducing zone to said desulfurization zone.

26. A desulfurization process comprising:

(a) combining a hydrogen stream and a hydrocarbon stream in a substantially continuous manner to thereby form a feed stream having a hydrogen-to-hydrocarbon molar ratio ($H_2$/HC), wherein said hydrogen stream has a hydrogen purity representing the mole percent of pure hydrogen ($H_2$) in said hydrogen stream;

(b) contacting said feed stream with a sorbent in a desulfurization zone under desulfurization conditions sufficient to transfer sulfur from said feed stream to said sorbent, wherein said desulfurization conditions include a total pressure ($P_T$) and a hydrogen partial pressure ($P_H$); and (c) simultaneously with step (b), adjusting an operating parameter selected from the group consisting of said $P_T$, said $H_2$/HC molar ratio, said hydrogen purity, and combinations thereof to thereby maintain said $P_H$ at a substantially constant value.

27. The desulfurization process according to claim 26, wherein said hydrogen purity varies over time and wherein step (c) is performed in response to variations in said hydrogen purity.

28. The desulfurization process according to claim 27, wherein said hydrogen purity varies by at least about 5 percent over time, wherein step (c) includes preventing said $P_H$ from varying by more than 5 percent over time.

29. The desulfurization process according to claim 27, wherein step (c) includes adjusting said $P_T$ upwardly in response to a decrease in said hydrogen purity or adjusting said $P_T$ downwardly in response to an increase in said hydrogen purity.

30. The desulfurization process according to claim 27, wherein step (c) includes adjusting said $H_2$/HC molar ratio upwardly in response to a decrease in said hydrogen purity or adjusting said $H_2$/HC molar ratio downwardly in response to an increase in said hydrogen purity.

31. The desulfurization process according to claim 27, wherein step (c) includes diluting said hydrogen stream with a diluent in response to an increase in said hydrogen purity or reducing the amount of said diluent added to said hydrogen stream, if any, in response to a decrease in said hydrogen purity.

32. The desulfurization process according to claim 26, wherein step (c) includes maintaining a $P_T/P_H$ ratio of at least 2.5 and maintaining said $H_2$/HC molar ratio below 0.7, wherein said desulfurization conditions include a temperature in the range of from about 750 to about 850° F.

33. The desulfurization process according to claim 26, further comprising:

(d) selecting a target hydrogen partial pressure ($P_{HT}$) for said desulfurization zone, wherein step (c) includes adjusting said operating parameter to maintain said $P_H$ within about 10 percent of said $P_{HT}$.

34. The desulfurization process according to claim 33, wherein said $P_{HT}$ is in the range of from about 50 to about 200 psia, wherein step (c) includes adjusting said operating parameter to maintain said $P_H$ within 5 percent of said $P_{HT}$.

35. The desulfurization process according to claim 34, wherein said $P_{HT}$ is in the range of from 60 to 150 psia, wherein said hydrogen purity varies by at least 10 percent over time, wherein step (c) includes maintaining a $P_T/P_H$ ratio in the range of from 3 to 6, wherein step (c) includes maintaining said $H_2$/HC molar ratio in the range of from 0.2 to 0.5, wherein said desulfurization conditions include a temperature in the range of from 770 to 830° F.

36. The desulfurization process according to claim 26, further comprising:

(e) contacting at least a portion of said sorbent with an oxygen-containing regeneration stream in a regeneration zone; and (f) contacting at least a portion of said sorbent with a hydrogen-containing reducing stream in a reducing zone.

37. The desulfurization process according to claim 36, wherein said sorbent comprises zinc oxide, wherein step (b) includes converting at least a portion of said zinc oxide to zinc sulfide, wherein step (e) includes converting at least a portion of said zinc sulfide to zinc oxide.

38. The desulfurization process according to claim 37, wherein said sorbent comprises a promoter metal component different from said zinc oxide and said zinc sulfide, wherein step (e) includes oxidizing said promoter metal component, wherein step (f) includes reducing said promoter metal component.

39. The desulfurization process according to claim 38, wherein said promoter metal component comprises one or more metals selected from the group consisting of nickel, cobalt, iron, manganese, tungsten, silver, gold, copper, platinum, zinc, tin, ruthenium, molybdenum, antimony, vanadium, iridium, chromium, and palladium.

40. The desulfurization process according to claim 38, wherein said promoter metal component comprises nickel.

41. The desulfurization process according to claim 36, wherein said desulfurization, regeneration, and reducing zones are defined by separate vessels.

42. The desulfurization process according to claim 41, further comprising:

(g) continuously transferring at least a portion of said sorbent from said desulfurization zone to said regeneration zone;

(h) continuously transferring at least a portion of said sorbent from said regeneration zone to said reducing zone; and (i) continuously transferring at least a portion of said sorbent from said reducing zone to said desulfurization zone.

43. A desulfurization process comprising:

(a) contacting a hydrocarbon-containing feed stream with a zinc oxide-containing sorbent composition under desulfurization conditions sufficient to remove sulfur from said feed stream and thereby provide a sulfur-loaded sorbent composition and a sulfur-reduced hydrocarbon-containing product stream, wherein said desulfurization conditions include a desulfurization temperature in the range of from about 770° F. to about 830° F.;

(b) contacting said sulfur-loaded sorbent composition with an oxygen-containing regeneration stream under regeneration conditions sufficient to remove sulfur from said sulfur-loaded sorbent composition and thereby provide an oxidized sorbent composition; and (c) contacting said oxidized sorbent composition with a hydrogen-containing reducing stream under reducing conditions sufficient to reduce said oxidized sorbent composition and thereby provide an activated sorbent composition.

44. The desulfurization process according to claim 43, wherein said desulfurization conditions include a desulfurization temperature in the range of from about 775 to about 825° F.

45. The desulfurization process according to claim 43, wherein said predominantly gasoline feed stream has a hydrogen-to-hydrocarbon ($H_2$/HC) ratio in the range of from about 0.2 to about 0.7, wherein said desulfurization conditions include a total pressure ($P_T$) in the range of from about 125 to about 650 psia.

46. The desulfurization process according to claim 45, wherein said predominantly gasoline feed stream has a sulfur content of at least 100 ppmw, wherein said sulfur-reduced predominantly gasoline product stream has a sulfur content that is less than 25 percent of the sulfur content of said predominantly gasoline feed stream.

47. The desulfurization process according to claim 46, wherein said sulfur-reduced predominantly gasoline product stream has an octane number ((R+M)/2) within 1.5 of said predominantly gasoline feed stream.

* * * * *